US008489403B1

(12) United States Patent
Griffin et al.

(10) Patent No.: US 8,489,403 B1
(45) Date of Patent: Jul. 16, 2013

(54) APPARATUSES, METHODS AND SYSTEMS FOR SPARSE SINUSOIDAL AUDIO PROCESSING AND TRANSMISSION

(75) Inventors: Anthony Griffin, Heraklio (GR); Athanasios Mouchtaris, Filothei (GR); Panagiotis Tsakalides, Heraklion (GR)

(73) Assignee: Foundation For Research and Technology—Institute of Computer Science 'FORTH-ICS', Crete (GR)

( * ) Notice: Subject to any disclaimer, the term of this patent is extended or adjusted under 35 U.S.C. 154(b) by 513 days.

(21) Appl. No.: 12/868,633

(22) Filed: Aug. 25, 2010

(51) Int. Cl.
*G10L 19/00* (2006.01)

(52) U.S. Cl.
USPC ..... 704/500; 704/230; 704/229; 704/226; 704/225; 704/223; 704/207; 704/200; 84/604; 714/752; 380/221; 375/260; 455/293

(58) Field of Classification Search
USPC ..... 704/500, 230, 229, 226, 225, 223, 704/207, 200; 84/604; 714/752; 455/293; 380/221; 375/260
See application file for complete search history.

(56) References Cited

U.S. PATENT DOCUMENTS 5,054,072 A * 10/1991 McAulay et al. ..... 704/207
5,179,626 A * 1/1993 Thomson ..... 704/200
5,274,711 A * 12/1993 Rutledge et al. ..... 704/225
5,826,222 A * 10/1998 Griffin ..... 704/207
5,963,899 A * 10/1999 Bayya et al. ..... 704/226
6,175,630 B1 * 1/2001 Katznelson ..... 380/221
8,229,009 B2 * 7/2012 Moffatt et al. ..... 375/260
8,271,275 B2 * 9/2012 Goto et al. ..... 704/223
8,332,216 B2 * 12/2012 Kurniawati et al. ..... 704/229
2004/0204936 A1 * 10/2004 Jensen et al. ..... 704/230
2008/0250913 A1 * 10/2008 Gerrits et al. ..... 84/604
2009/0171672 A1 * 7/2009 Philippe et al. ..... 704/500
2010/0023335 A1 * 1/2010 Szczerba et al. ..... 704/500
2010/0115370 A1 * 5/2010 Laaksonen et al. ..... 714/752
2011/0294453 A1 * 12/2011 Mishali et al. ..... 455/293

OTHER PUBLICATIONS

Levine, Multiresolution sinusoidal modeling for wideband audio with modifications, all pages, CCRMA, 1998.*

* cited by examiner

*Primary Examiner* — Michael Colucci
(74) *Attorney, Agent, or Firm* — Chadbourne & Parke LLP

(57) ABSTRACT

The APPARATUSES, METHODS AND SYSTEMS FOR SPARSE SINUSOIDAL AUDIO PROCESSING AND TRANSMISSION (hereinafter "SS-Audio") provides a platform for encoding and decoding audio signals based on a sparse sinusoidal structure. In one embodiment, the SS-Audio encoder may encode received audio inputs based on its sparse representation in the frequency domain and transmit the encoded and quantized bit streams. In one embodiment, the SS-Audio decoder may decode received quantized bit streams based on sparse reconstruction and recover the original audio input by reconstructing the sinusoidal parameters in the frequency domain.

20 Claims, 23 Drawing Sheets

(a) Primary Audio Channel (b) c-th Audio Channel

Reconstructed frames showing the effects of 4-bit quantization and spectral whitening.

*(i).* Results of quality rating listening test for 10 sinusoids per frame, for various choices of bits per sample ($Q$) and number of random samples ($M$).

*(ii).* Results of the preference listening tests for 10 sinusoids with $Q = 4$, $M = 60$ signals (black) over $Q = 3$, $M = 80$ signals (grey).

Quality Rating Performance Demonstrations for Various Stereo Signals

APPARATUSES, METHODS AND SYSTEMS FOR SPARSE SINUSOIDAL AUDIO PROCESSING AND TRANSMISSION

FIELD

The present invention is directed generally to apparatuses, methods, and systems of audio processing and transmission, and more particularly, to APPARATUSES, METHODS AND SYSTEMS FOR SPARSE SINUSOIDAL AUDIO PROCESSING AND TRANSMISSION.

BACKGROUND

Advances in the compression and transmission of audio signals have come about to keep pace with the growing digitization of information, including multimedia content such as video and audio data. Multi-channel audio is a form of multimedia content that allows the recreation of rich sound scenes through the transmission of multiple audio channels. The structure of multiple channels gives the listener the sensation of being "surrounded" by sound and immerses him with a realistic acoustic scene.

SUMMARY

The APPARATUSES, METHODS AND SYSTEMS FOR SPARSE SINUSOIDAL AUDIO PROCESSING AND TRANSMISSION (hereinafter "SS-Audio") provide a platform for encoding and decoding audio signals based on a sparse sinusoidal structure. In one embodiment, the SS-Audio encoder may encode received audio inputs based on its sparse representation in the frequency domain and transmit the encoded and quantized bit streams. In one embodiment, the SS-Audio decoder may decode received quantized bit streams based on sparse reconstruction and recover the original audio input by reconstructing the sinusoidal parameters in the frequency domain.

In one embodiment, an audio encoding processor-implemented method is disclosed, comprising: receiving audio input from an audio source; segmenting the received audio input into a plurality of audio frames; for each segmented audio frame: determining a plurality of sinusoidal parameters of the segmented audio frame, modifying the determined plurality of sinusoidal parameters via a pre-conditioning procedure at a frequency domain, converting the modified plurality of sinusoidal parameters into a modified time domain representation, obtaining a plurality of random measurements from the modified time domain representation, and generating binary representation of the segmented audio frame by quantizing the obtained plurality of random measurements; and sending the generated binary representation of each segmented audio frame to a transmission channel.

In one embodiment, an audio decoding processor-implemented method is disclosed, comprising: receiving a plurality of audio binary representations and side information from an audio transmission channel; converting the received plurality of binary representations into a plurality of measurement values; generating estimates of a set of sinusoidal parameters based on the plurality of measurement values; modifying the estimates of the set of sinusoidal parameters based on the side information; and generating an audio output by transforming the modified estimates of the set of sinusoidal parameters into a time domain.

In one embodiment, a multi-channel audio encoding processor-implemented method is disclosed, comprising: receiving a plurality of audio inputs from a plurality of audio channels; determining a primary channel input and a plurality of secondary channel inputs from the received plurality of audio inputs; segmenting each audio input into a plurality of audio frames; determining a plurality of sinusoidal parameters of the segmented audio frames based on all channel inputs; for the primary audio channel input, modifying the determined plurality of sinusoidal parameters via a pre-conditioning procedure at a frequency domain; for secondary audio channel frames, obtaining frequency indices of sinusoidal parameters from primary audio channel encoding; converting the modified plurality of sinusoidal parameters into a modified time domain representation; obtaining a plurality of random measurements from the modified time domain representation; generating binary representation of the segmented audio frames of all channels by quantizing the obtained plurality of random measurements; and sending the generated binary representation of the segmented audio frames of all channels to a transmission channel.

In one embodiment, a multi-channel audio decoding processor-implemented method is disclosed, comprising: receiving a plurality of audio binary representations and side information from a audio channel and a secondary audio channel; converting the received plurality of binary representations into a plurality of measurement values; for the primary audio channel, generating estimates of a set of sinusoidal parameters based on the plurality of measurement values, and modifying the estimates of the set of sinusoidal parameters based on the side information; for the secondary audio channel, obtaining estimates of frequency indices of sinusoidal parameters from primary audio channel decoding; and generating audio outputs for both the primary audio channel and the secondary audio channel by transforming the modified estimates of the set of sinusoidal parameters of both channels into a time domain.

BRIEF DESCRIPTION OF THE DRAWINGS

The accompanying appendices and/or drawings illustrate various non-limiting, example, inventive aspects in accordance with the present disclosure.

The leading number of each reference number within the drawings indicates the figure in which that reference number is introduced and/or detailed. As such, a detailed discussion of reference number 101 would be found and/or introduced in FIG. 1. Reference number 201 is introduced in FIG. 2, etc.

DETAILED DESCRIPTION

SS-Audio

The APPARATUSES, METHODS AND SYSTEMS FOR SPARSE SINUSOIDAL AUDIO PROCESSING AND TRANSMISSION (hereinafter "SS-Audio") provides a platform for encoding and decoding audio signals based on a sparse sinusoidal structure.

For example, in one implementation, the SS-Audio may be employed by a stereo sound system, which receives audio signal inputs from a variety of audio sources, such as, but not limited to a CD-ROM, a microphone, a digital media player loading audio files in a variety of formats (e.g., mp3, wmv, way, wma, etc.) and/or the like. In one implementation, the SS-Audio may receive audio signals from a single input channel. In an alternative implementation, the SS-Audio may receive audio signals from multiple channels. In one embodiment, the received audio inputs may be represented as sum of sparse sinusoidal components, whereby a SS-Audio encoder may encode the sinusoidal parameters in the frequency domain and transmit the encoded and quantized bit streams. In one embodiment, the SS-Audio decoder may decode received quantized bit streams and recover the original audio signal by reconstructing the sinusoidal parameters in the frequency domain. The recovered audio signal may be sent for reproduction, such as, but not limited to a sound remix system, a loudspeaker, a headphone, and/or the like.

It is to be understand that, although the SS-Audio discussed herein is within the context of system implemented sinusoidal coding/de-coding of a single and/or multiple channel audio signal processing and transmission, the SS-Audio features may be adapted to other data processing and/or encoding applications, may be applied to other forms of data (e.g., video), may employ other signal approximation models, and/or the like.

Figure 1:
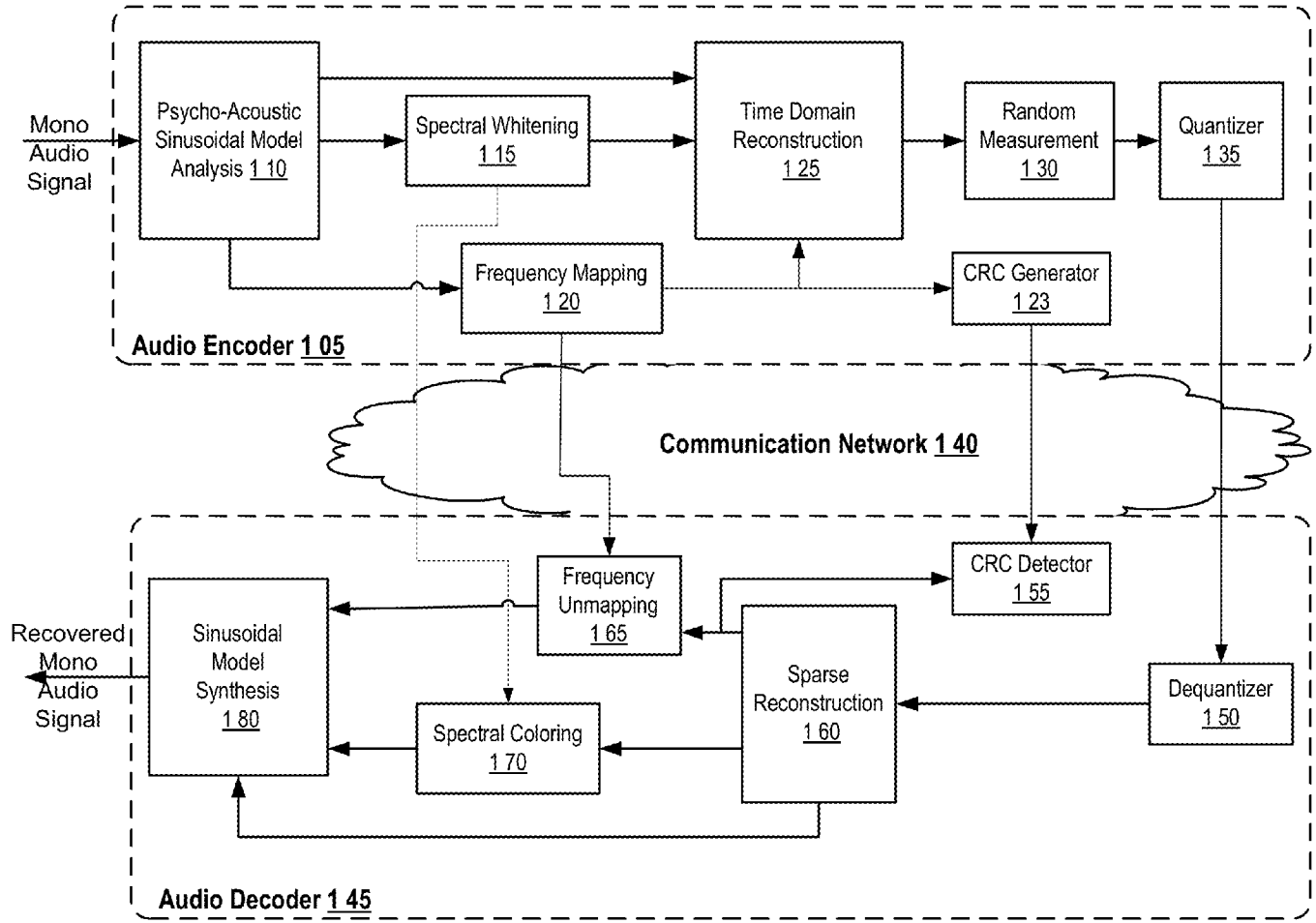
FIG. 1 is of a block diagram illustrating an exemplar overview of encoding and decoding a monophonic audio signal within embodiments of the SS-Audio.
Figure 2A:
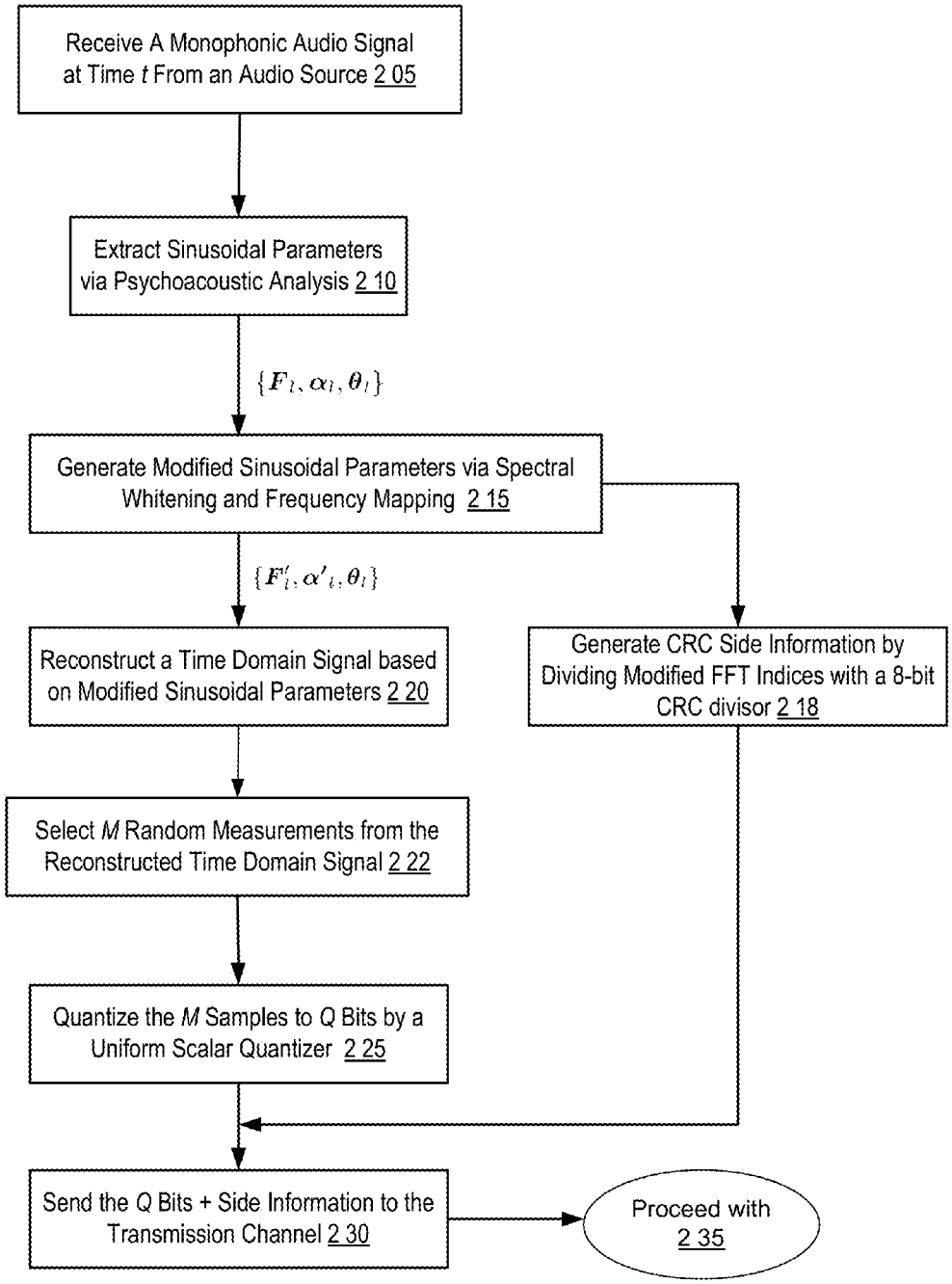
FIGS. 2A-B are of logic flow diagrams illustrating encoding and decoding a monophonic audio signal within embodiments of the SS-Audio.
Figure 2B:
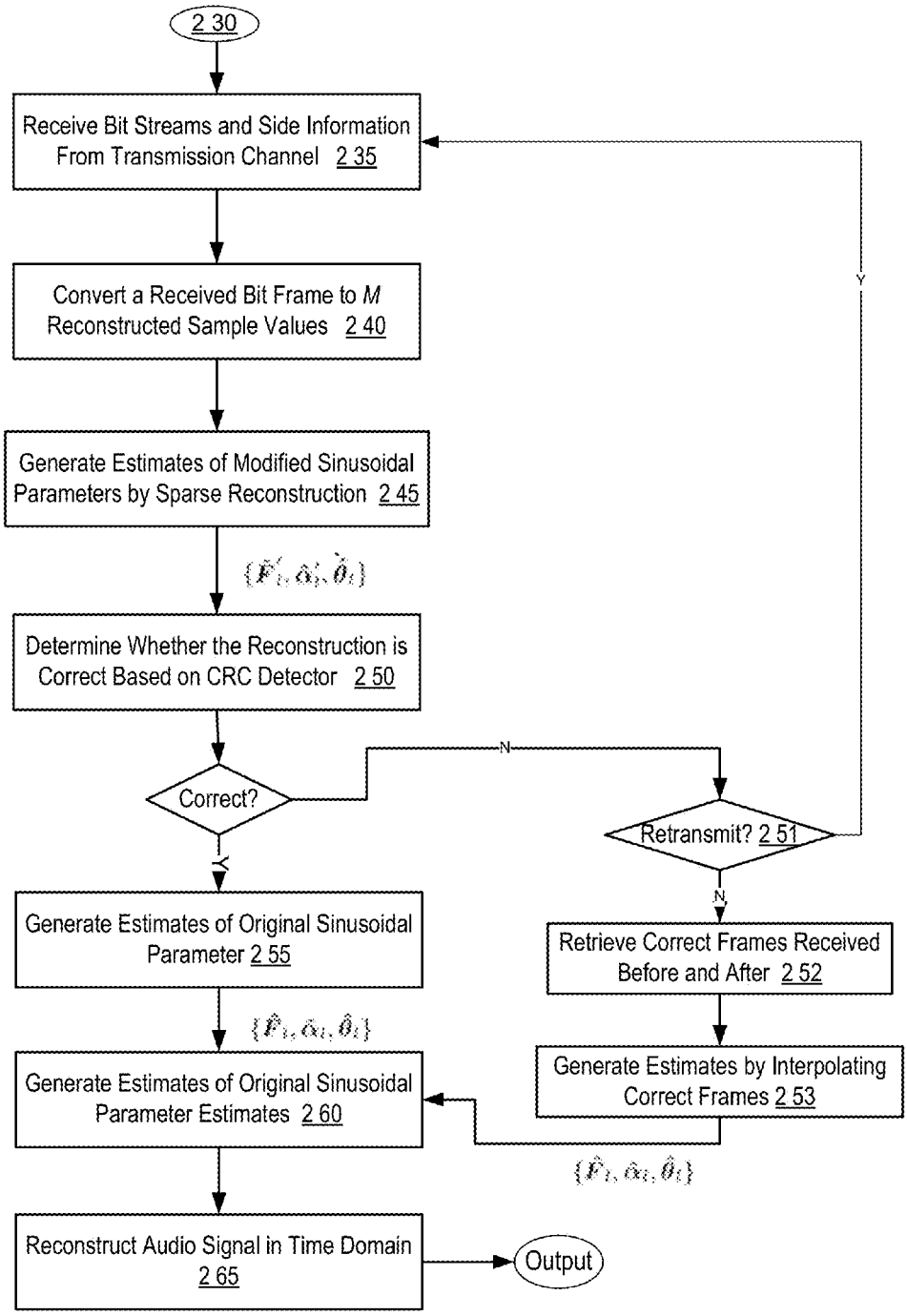

FIGS. 1 and 2A-B provide diagrams illustrating encoding and decoding a monophonic audio signal within embodiments of the SS-Audio. In one embodiment, a monophonic audio signal may be received from an audio source at a SS-Audio encoder 105. In one embodiment, the SS-Audio may extract sinusoidal parameters of the received audio signal 210, such as, but not limited to amplitude, frequency, phase, and/or the like.

In one implementation, the SS-Audio may segment the received signal s(t) into a number of short-time frames and a short-time frequency representation may be computed for each frame to estimate parameters of the received audio signal. In one implementation, the SS-Audio may take each peak at the l-th frame of the received signal and obtain a triad of parameter values in the form $\{\alpha_{l,k}, f_{l,k}, \theta_{l,k}\}$ (amplitude, frequency, phase), corresponding to the k-th sinewave component. In an alternative implementation, the SS-Audio may employ a peak continuation procedure in order to assign each peak to a frequency trajectory using interpolation methods, as further described in "Spectral modeling synthesis: A sound analysis/synthesis system based on a deterministic plus stochastic decomposition" by "X. Serra and J. O. Smith, published in Computer Music Journal, vol. 14(4), pp. 12-24, Winter 1990, the entire contents of which are herein expressly incorporated by reference.

In an alternative embodiment, the SS-Audio may obtain sinusoidal parameters from the frequency domain, e.g., the positive frequency indices from Fast Fourier Transform (FFT). For example, in one implementation, the SS-Audio may choose N samples of the received audio signal s(t) within the received l-th frame, denoted by $x_l=\{x_{l,0}, x_{l,2}, \ldots, x_{l,N-1}\}$, to compute its frequency domain representation via FFT, which may take a form similar to the following:

$$X_{l,m} = \sum_{n=0}^{N-1} \exp\{-2\pi imn/N\} \cdot x_{l,n},\ m = 0, 1, \ldots, N-1.$$

Wherein N may be referred to as the size of the FFT.

In one implementation, the SS-Audio may determine the positive frequency indices of $X_l$, denoted as $F_l$ and thus obtain a triad of sinusoidal parameters $\{F_l, \alpha_l, \theta_l\}$ (frequency, amplitude, phase) of the frequency domain representations, where $F_l$, $\alpha_l$ and $\theta_l$ are vector representations (vectors are denoted by bold letters hereinafter) of $F_{l,k}$, $\alpha_{l,k}$ and $\theta_{l,k}$, respectively, and $F_{l,k}$ is the positive FFT frequency index of the k-th sinewave component, which is related to $f_{l,k}$ by $f_{l,k}=2\pi F_{l,k}/N$.

In one implementation, the received signal may be passed through a psycho-acoustic sinusoidal analysis block no to extract sinusoidal parameters. In one implementation, the monophonic audio signal may be represented as the sum of a small number K of sinusoids with time-varying amplitudes and frequencies, e.g., $$s(t) = \sum_{k=1}^{K} \alpha_k(t)\cos(\beta_k(t)),$$

where $\alpha_k(t)$ and $\beta_k(t)$ are the instantaneous amplitude and phase of the received monophonic audio signal, respectively.

Figure 5A:
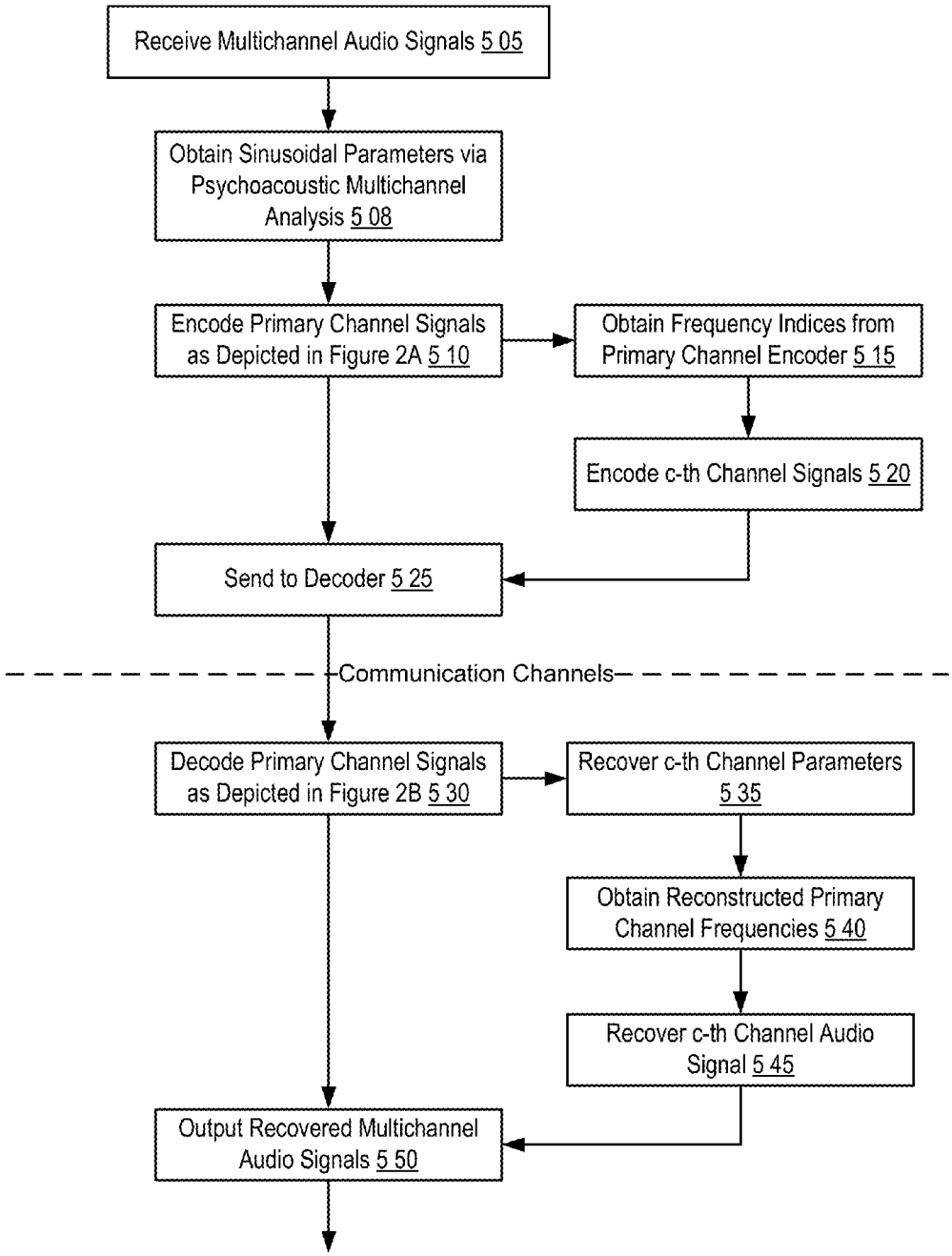
FIG. 5A is of a logic flow diagram illustrating encoding and decoding multi-channel audio signals within embodiments of the SS-Audio.
Figure 5B:
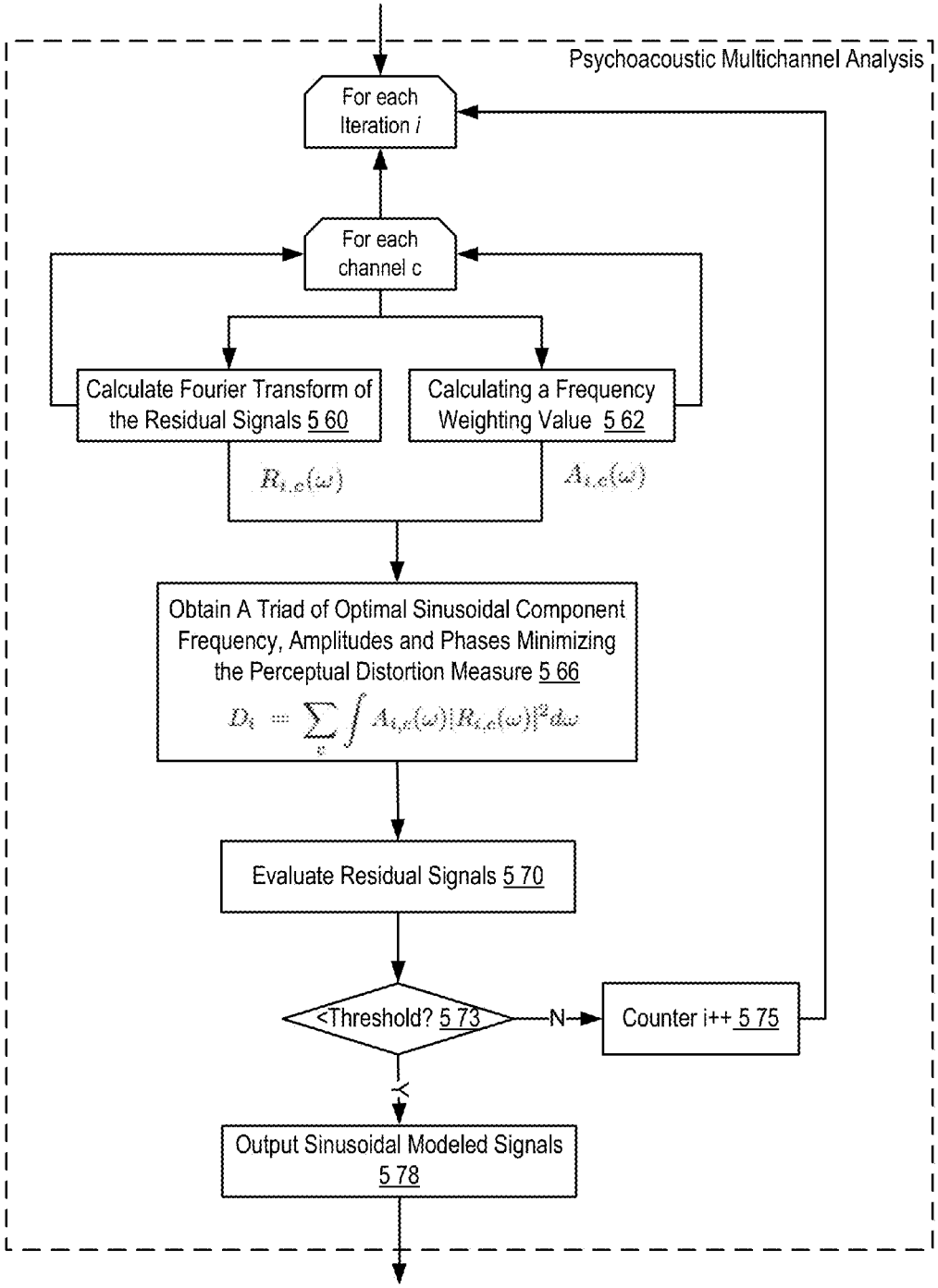
FIG. 5B is of a logic flow diagram illustrating psychoacoustic multi-channel analysis of multi-channel signals within embodiments of the SS-Audio.

In one embodiment, the received monophonic audio signal may be passed through a psychoacoustic sinusoidal modeling block no to determine the parameter triad $\{F_l, \alpha_l, \theta_l\}$, as further illustrated in FIG. 5B. In one implementation, the SS-Audio may adopt signal representation for the K sinusoids as the major audio components only. In an alternative implementation, the signal representation may include the sinusoidal error signal component. For example, after the sinusoidal parameters $\{\alpha_{l,k}, f_{l,k}, \theta_{l,k}\}$ or $\{F_l, \alpha_l, \theta_l\}$ are estimated, the noise component may be computed by subtracting the harmonic component from the original signal.

In one embodiment, upon determining sinusoidal parameter triad $\{F_l, \alpha_l, \theta_l\}$ of the received signal, the SS-Audio may pass the audio signal to "pre-conditioning" phases, such as, but not limited to spectral whitening 115 and frequency mapping 120, and/or the like. In one implementation, these "pre-conditioning" phases may generate modified sinusoidal parameters 215 $\{F'_l, \alpha'_l, \theta_l\}$ via spectral whitening 115 and frequency mapping 120.

In one implementation, the SS-Audio may divide each amplitude $\alpha_l$ by a quantized (e.g., 3-bit, 5-bit, etc.) version of itself to obtain a "whitened" amplitude $\alpha'_l$, and send this whitening information to a spectral coloring block 170 in the audio decoder 145. The performance and impact of the spectral whitening is further illustrated in FIGS. 6A-B.

In an alternative implementation, the SS-Audio may adopt envelope estimation of the sinusoidal amplitudes to whiten the spectral, as further illustrated in "Regularized estimation of spectrum envelope from discrete frequency points" by O. Cappe, J. Laroche, and E. Moulines, published in IEEE ASSP Workshop on App. of Sig. Proc. to Audio and Acoust, October 1995, which is expressly incorporated herein by reference.

In one embodiment, the SS-Audio may adopt frequency mapping techniques to alleviate the trade-off between the amount of encoded information and the frequency resolution of the sinusoidal model (in other words, the trade-off between the number of random measurements M and the number of bins used in the FFT, N), which affects the resulting quality of the modeled audio signal. In one implementation, the SS-Audio may reduce the effective number of bins for FFT by a factor $C_{FM}$, referred to as the frequency mapping factor, which leads to an adjusted number of bins $N_{FM}=N/C_{FM}$. The factor $C_{FM}$ may be pre-determined by a system configurer. For example, in one implementation, $C_{FM}$ may be selected as power of two so that the resulting $N_{FM}$ will also be a power of two, suitable for use in an FFT.

In one implementation, the SS-Audio may calculate a modified frequency $F'_l$, a mapped version of $F_l$, whose components are calculated in one example as:

$$F'_{l,k} = \left\lfloor \frac{F_{l,k}}{C_{FM}} \right\rfloor, k = 1, 2, \ldots, K,$$

where $\lfloor\rfloor$ denotes the floor function.

In one implementation, the SS-Audio calculates $\dot{F}_l$ with components $\dot{F}_{l,k}$ given by: $\dot{F}_{l,k}=F_{l,k} \bmod C_{FM}$.

In one implementation, the SS-Audio may map a number of received signal frames using the same value of $C_{FM}$. In an alternative implementation, the SS-Audio may determine the factor $C_{FM}$ for each frame based on its specific distribution of $F_l$. In one implementation, the SS-Audio may choose $C_{FM}$ to ensure each mapping produces a distinct frequency component $F'_{l,k}$, k=1, . . . , K. For example, in one implementation, the frames may be chosen to be mapped by a $C_{FM}$ equal to 4 and an $N_{FM}=64$.

In one embodiment, the SS-Audio may implement error correction techniques to minimize the probability of frame reconstruction errors (FREs) which may occur during the audio encoding and decoding processes. For example, in one implementation, the SS-Audio may employ forward error correction to detect whether an FRE has occurred, e.g., an 8-bit cyclic redundancy check (CRC 123) on frequency indices. For example, in one implementation, the SS-Audio may generate CRC side information by dividing the modified FFT indices $F'_l$ by an 8-bit CRC divisor 218.

In one implementation, an example C implementation of 8-bit CRC may take a form similar to:

```
unsigned int calc_crc_core(unsigned int *start,unsigned int *end) {
  unsigned int crc=0,c;
  int i;
  while (start<=end) {
    c=*start;
    for(i=0;i<8;i++) {
      if((crc^c) & 1) crc=(crc>>1)^0xA001;
      else crc>>=1;
      c>>=1;
    }
    start++;
  }
  return(crc);
}
```

In one embodiment, the SS-Audio may reconstruct an audio signal in the time domain 125 based on the modified sinusoidal parameters $\{F'_l, \alpha'_l, \theta_l\}$ 220, e.g., a "spectral whitened" and "frequency mapped" signal. The reconstructed time domain signal may then be passed through a random measurements block 130 and a quantizer 135, whereby the SS-Audio may then sample and quantize the time domain signal in one implementation by selecting M random measurements 222 and quantize the M sample values to Q-bit binary representations by a uniform scalar quantizer 225, as further illustrated in FIG. 3A. As used herein, random measurements may include a variety of different implementations, such as, but not limited to random sampling, linear combinations of random measurements, and/or the like.

In one embodiment, the SS-Audio may send Q-bit binary streams of quantized audio signal and side information for transmission 230. In one implementation, the side information may include, but not limited to spectral whitening variables $\alpha'_l$, frequency mapping factor $C_{FM}$, residual frequency values $\dot{F}_l$, the CRC side information, and/or the like.

In one implementation, the SS-Audio may packetize the encoded audio signal for transmission. For example, in one implementation, a transmitted audio data packet may take a form such that the quantized audio data may be the payload portion of a packet and the side information may constitute the overhead. In one implementation, the transmitted audio data may comport with a variety of audio format, such as, but not limited to MP3, AAC, WMA, and/or the like.

In one implementation, the encoded audio signal may be transmitted to an audio decoder 145 via a communication network 140. In one implementation, the communication network 140 may be a wired connection, such as a single/multiple channel audio connector, and/or the like. In an alternative implementation, the communication network 140 may be a Bluetooth connection, Internet, WiFi, 3G network, LAN and/or the like.

As shown in FIGS. 1 and 2B, in one embodiment, the SS-Audio receiver may receive bit streams of audio signal as well as side information from a transmission channel 235, and convert received bit frames to M reconstructed sample values 240 via a dequantizer 150.

In one embodiment, the SS-Audio may reconstruct the audio signal by generating estimates of sinusoidal parameters 245. For example, in one implementation, the dequantized audio signal may be passed to a sparse reconstruction block 160 (e.g., using sparse linear observation), which may utilize the sparsity of the original audio signal and implement a compressed sensing based reconstruction method, which may be further discussed in one implementation in the following:

As discussed in one implementation at 210, $x_l$ denotes the N samples of the harmonic component in the sinusoidal model in the l-th frame of the input signal, which is a K-sparse signal in the frequency domain. In one implementation, the N-point FFT of $x_l$ may be written by matrix representation as $x_l=\Psi X_l$, where $\Psi$ is the N×N inverse FFT matrix, and $X_l$ is the FFT of $x_l$. As is a real signal, $X_l$ will contain 2K non-zero complex entries representing the real and imaginary parts, which are the amplitudes and phases of the component sinusoids, respectively.

In one implementation, the random measurement at the encoder may take M non-adaptive linear measurements of $x_l$, where M<<N, resulting in an M×1 vector $y_l$. The random measurement process may be written as $y_l=\Phi_l x_l=\Phi_l \Psi X_l$ where $\Phi_l$ is an M×N matrix representing the measurement process. In one implementation, the matrices $\Phi_l$ and $\Psi$ may be chosen as incoherent. For example, in one implementation, matrices with elements chosen in random manners may be used, such as, but not limited to taking random measurements in the time domain to satisfy the incoherence condition. For example, $\Phi_l$ may be formed by randomly-selected rows of an N×N identity matrix, which may take a form similar to the following in one example:

$$\Phi_l = \begin{bmatrix} 1 & 0 & 0 & \dots & 0 & 0 \\ 0 & 0 & 1 & \dots & 0 & 0 \\ 0 & \dots & 1 & \dots & 0 & 0 \\ \dots & & & & & \\ 0 & \dots & 0 & 1 & \dots & 0 \end{bmatrix}_{M\times N}$$

In another implementation, matrices with random entries other than zero/one entries may be employed as a random linear combination of samples in order to obtain random measurements.

In one embodiment, if $y'_l$ denotes the received measurements from random measurement at the decoder, the SS-Audio may generate an estimate $\hat{X}'_l$ of the sparse vector $X'_l$. For example, in one implementation, a compressed sensing based approach may take a form similar to the following optimization problem:

$$\hat{X}'_l=\arg\min\|X'_l\|_p,\ s.t.\ y'_l=\Phi_l\Psi X'_l$$

wherein $\|\cdot\|_p$ is the $l_p$ norm defined as $|a|_p=(\Sigma_i|a_i|^p)^{1/p}$. In one implementation, the SS-Audio may choose p<1. In an alternative implementation, the SS-Audio may adopt a hybrid reconstruction approach employing different p values dependent on the decoding performance, as further illustrated in FIG. 3B.

In one embodiment, upon obtaining an estimate $\{\hat{F}'_l, \hat{\alpha}'_l, \hat{\theta}_l\}$ from the reconstructed $\hat{X}'_l$, the SS-Audio may determine whether the reconstruction is correct based on the CRC detector 155, 250. In one implementation, the SS-Audio may utilize the received CRC side information, including an 8-bit CRC divisor and the information bits representing the frequency indices divided by the CRC divisor. In one implementation, the SS-Audio may divide the generated frequency estimate $\hat{F}'_l$ by the same CRC divisor and compare the result with the received CRC information.

In one embodiment, if the CRC detection shows there is an FRE, implying the reconstruction is not correct, the SS-Audio may determine whether there is retransmission 251 of the incorrect frame. For example, in one implementation, the receiver may send an error message to the transmitter, and the transmitter may retransmit the frame. If the decoder receives a retransmitted frame, the SS-Audio may reconstruct the signal frame proceeding with 235. If no retransmission has been detected, the SS-Audio may utilize interpolation techniques to recover the error frame. For example, in one implementation, the SS-Audio may retrieve received and correctly decoded frames before and after the error frame 252, and generate estimates of the error frame by interpolation 253.

In alternative embodiment, if no FRE occurs for the instant transmitted frame, the SS-Audio may recover original sinusoidal parameters $\{\hat{F}_l, \hat{\alpha}_l, \hat{\theta}_l\}$ 260 from the generated estimates $\{\hat{F}'_l, \hat{\alpha}'_l, \hat{\theta}_l\}$. In one implementation, the reconstructed signal may be passed through spectral coloring process 170 and frequency unmapping process 165 to recover the original audio signal before the spectral whitening and frequency mapping at the encoder. For example, in one implementation, the SS-Audio may retrieve from the received side information the 3-bit quantized version of the original amplitude and multiply it by $\hat{\alpha}'_l$ to recover the original amplitudes $\hat{\alpha}_l$. In another implementation, the SS-Audio may also retrieve frequency mapping factor frequency mapping factor $C_{FM}$, and residual frequency values $\dot{F}_l$ from the received side information to calculate the elements of $\hat{F}_l$, e.g., $$\hat{F}_{l,k}=C_{FM}\hat{F}'_{l,k}+\dot{F}_{l,k}.$$

In one embodiment, the SS-Audio may reconstruct the audio signal in the time domain 265 at the sinusoidal model synthesis block 180. For example, in one implementation, the recovered monophonic audio signal may be sent to sound reproduction.

Figure 2C:
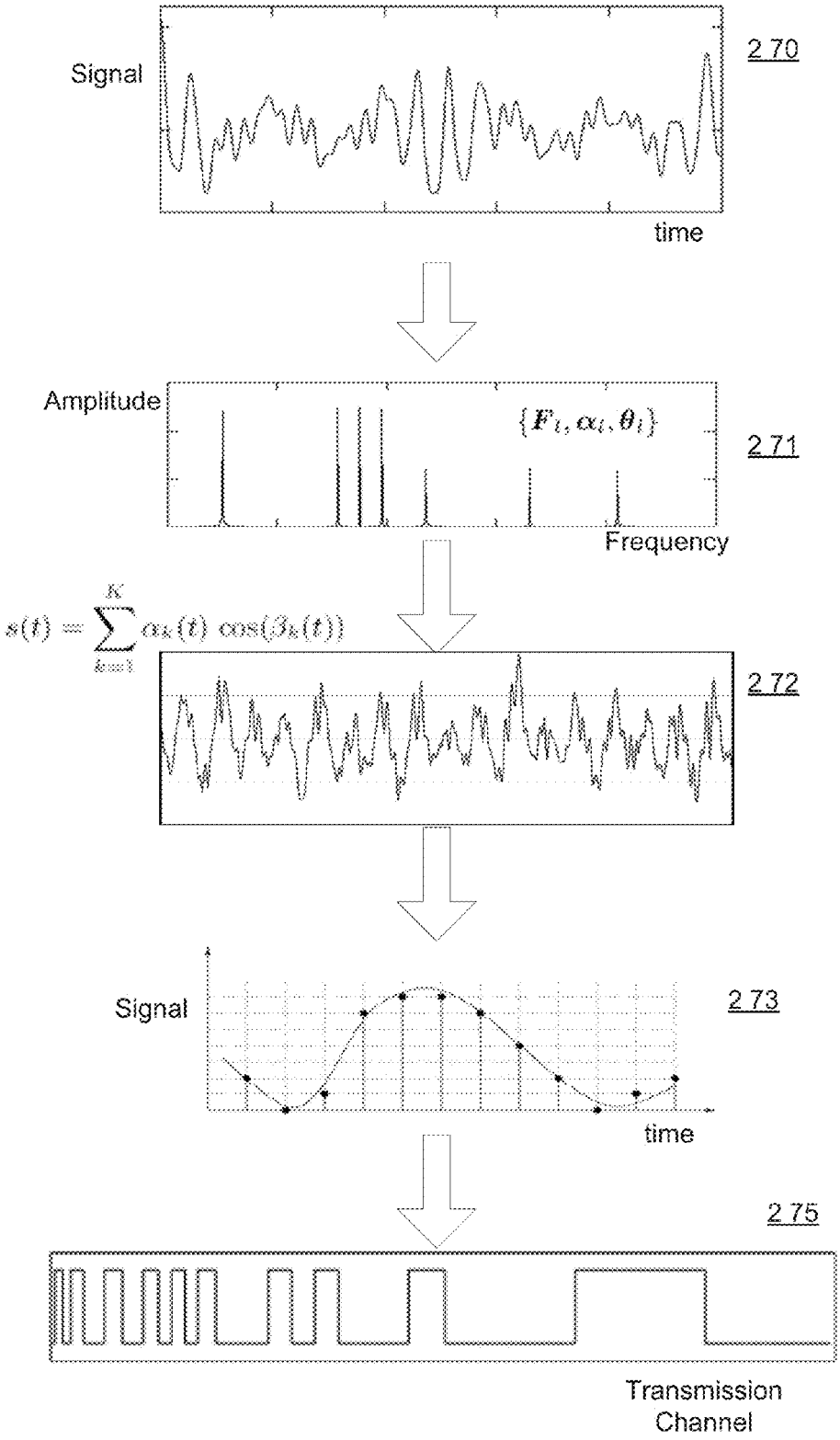
FIGS. 2C-D are of diagrams of exemplar waveforms illustrating audio signal samples of the SS-Audio encoding and decoding within embodiments of the SS-Audio.
Figure 2D:
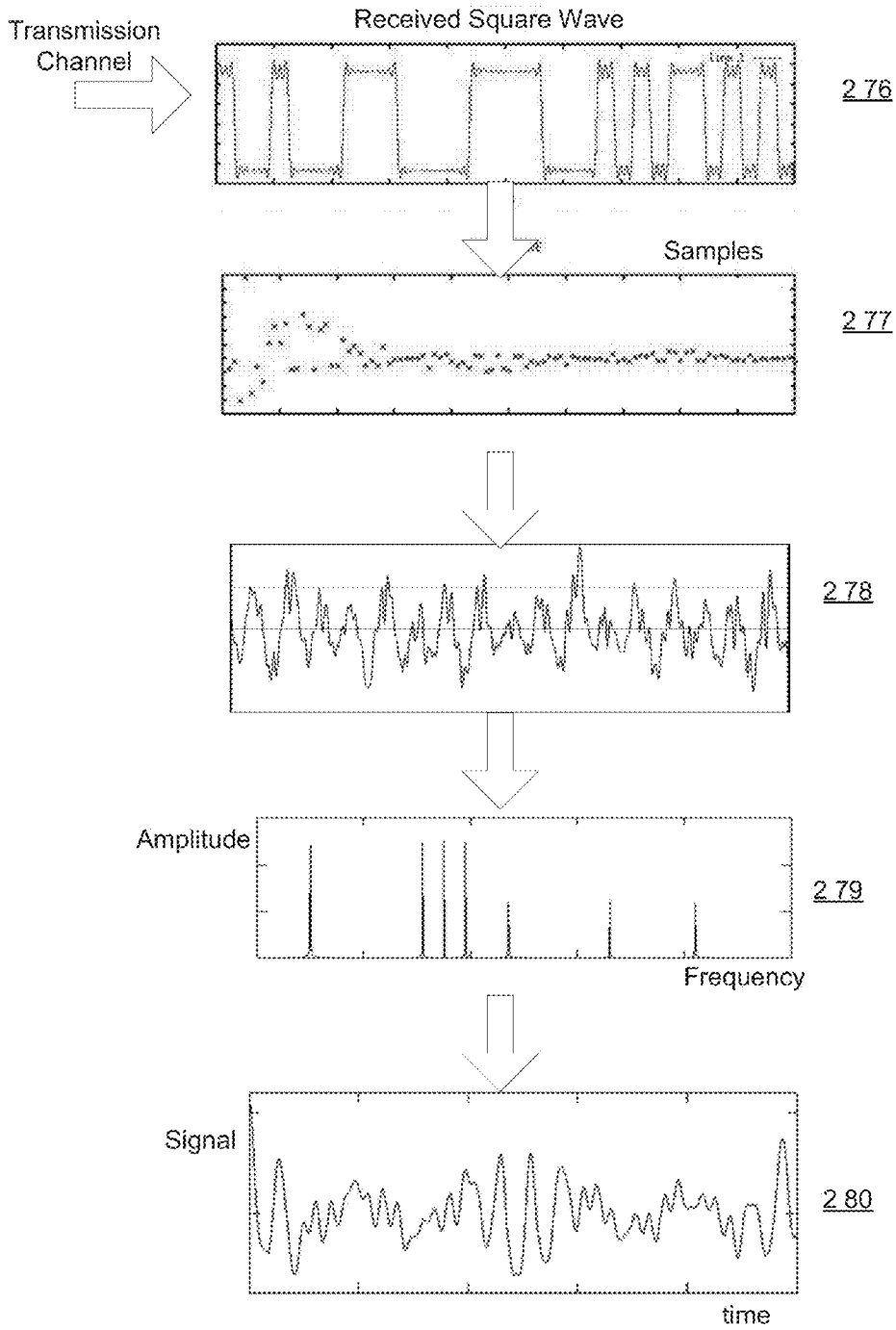

FIGS. 2C-D provide diagrams of exemplar waveforms illustrating audio signal samples in the SS-Audio encoding and decoding processing within embodiments of the SS-Audio. It is to be noted that the exemplar waveforms provided in FIGS. 2C-D are for illustrative purposes only, and may not intend to be accurate numerical representations.

As shown in FIG. 2C, in one embodiment, the encoder of the SS-Audio may receive a monophonic audio signal 270 from an audio source, which may be a sum of multiple sinusoidal waves at different frequencies, including the audio sinusoids and noise component. The source audio signal 270 may be transformed to the frequency domain by FFT, showing a series of positive frequency indices 271. In one implementation, the SS-Audio may determine the K sinusoidal components with positive frequency indices, and pass the K-sparse audio signal for "pre-conditioning", as discussed in FIGS. 1 and 2A. The pre-conditioned K-sparse signal may then be transformed to the time domain, which may be a sum of the K sinusoids with time-varying amplitudes and frequencies 272. In one implementation, the K-sparse signal 272 may be measured in the time domain 273, by sampling the signal 272, and the sampled value may be encoded into binary bits and the bit stream 275 may be transmitted.

In one embodiment, at the decoder of the SS-Audio, as shown in FIG. 2D, a square wave 276 representing the transmitted bit stream with additive noise component from the transmission channel may be received. The SS-Audio may dequantize the received square wave 276 and recover values of the transmitted sinusoidal parameters 277. In one implementation, the SS-Audio may reconstruct the audio signal via sparse reconstruction, as discussed in FIGS. 1 and 2B, and obtain sinusoidal parameters in the frequency domain 278. In one implementation, the SS-Audio may transform the signal to the time domain 279, and obtain the original signal, the continuous time waveform 280 via sinusoidal model synthesis.

Figure 3A:
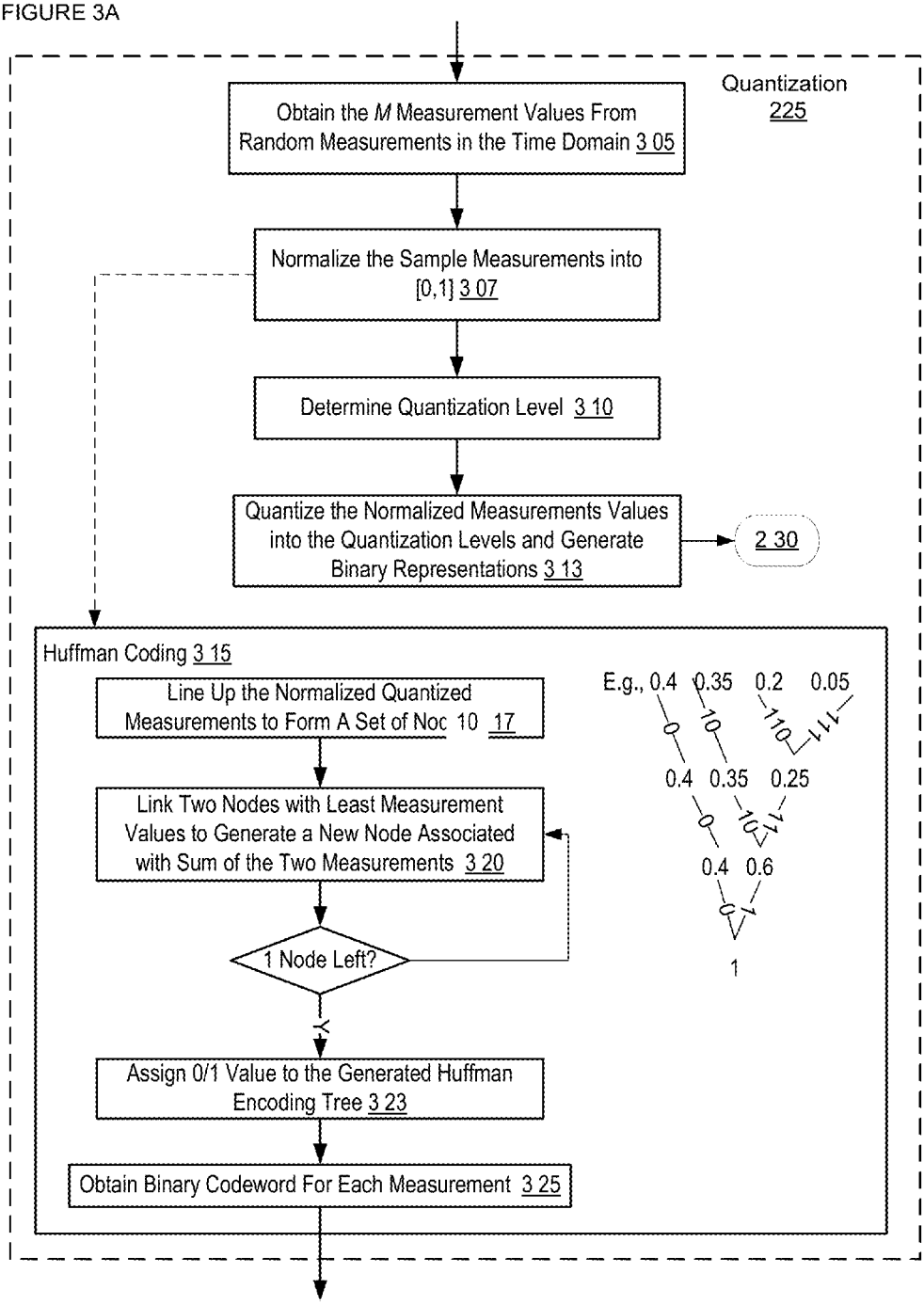
FIG. 3A is of a logic flow diagram illustrating quantization of an audio signal within embodiments of the SS-Audio.

FIG. 3A provides a logic flow diagram illustrating quantization 225 of an audio signal within embodiments of the SS-Audio. In one embodiment, the SS-Audio may obtain the M measurement values from random measurement in the time domain 305, and quantize the discrete measurements of the audio signal at the encoder by uniform scalar quantizing techniques. In one implementation, the SS-Audio may normalize the sample measurements into an interval of [0,1] 307, and determine a quantization level 310. For example, in one implementation, if the M measurements are denoted by $b_1, b_2, b_3, \dots, b_M$, sorted from the smallest to the greatest, then a normalized measurement $\bar{b}_i$ may be calculated by:

$$\bar{b}_i = \frac{b_i}{b_1 + b_2 + \ldots + b_M}, \; i = 1, 2, \ldots, M,$$

and a quantization level, e.g., a number of bits based on the range and number of measurements. For example, in one implementation, a number of quantization level may be chosen as $\lceil \log_2 M \rceil$, where $\lceil \cdot \rceil$ denotes the ceiling function. In one implementation, the normalized measurement values may then be assigned to into the quantization levels and generate binary representations of the M measurements 313.

In a further implementation, the SS-Audio may employ an entropy coding technique to reduce the number of bits required for each quantization value. In one implementation, the entropy coding is a lossless data compression technique, which maps the more probable codewords (quantization indices) into shorter bit sequences and less likely codewords into longer bit sequences. For example, in one implementation, as illustrated in FIG. 3A, Huffman coding 315 may be adopted as an entropy coding technique to reduce the number of bits required for quantization.

In one implementation, the average codeword length may be reduced after the Huffman coding, wherein the average codeword length is defined in one implementation as:

$$\text{average codeword length} = \sum_{i=1}^{2^n} p_i L_i,$$

where $p_i$ is the probability of occurrence for the i-th codeword, L is the length of each codeword and $2^n$ is the total number of codewords, as n is the number of bits assigned to each codeword before the Huffman encoding.

Table 1 presents an example illustrating the percentages of compression that may be achieved through Huffman encoding for a variety of different audio signal for Q=3, 4, and 5 bits of quantization. As shown in Table 1, the compression decreases as Q increases, but for a choice of Q=4, a compression of about 8% may be achieved by utilizing Huffman coding.

TABLE 1

Compression Achieved After Entropy Coding.

| Signal | Q | $\bar{Q}$ | PC | Q | $\bar{Q}$ | PC | Q | $\bar{Q}$ | PC |
|---|---|---|---|---|---|---|---|---|---|
| Violin | 3 | 2.64 | 11.9% | 4 | 3.70 | 7.5% | 5 | 4.73 | 5.4% |
| Harpsichord | 3 | 2.62 | 12.7% | 4 | 3.67 | 8.2% | 5 | 4.70 | 6.1% |
| Trumpet | 3 | 2.60 | 13.6% | 4 | 3.63 | 9.3% | 5 | 4.66 | 6.8% |
| Soprano | 3 | 2.59 | 13.7% | 4 | 3.62 | 9.4% | 5 | 4.65 | 7.0% |
| Chorus | 3 | 2.64 | 12.2% | 4 | 3.68 | 8.0% | 5 | 4.71 | 5.9% |
| Female speech | 3 | 2.60 | 13.2% | 4 | 3.64 | 9.0% | 5 | 4.68 | 6.5% |
| Male speech | 3 | 2.60 | 13.4% | 4 | 3.63 | 9.2% | 5 | 4.66 | 6.8% |
| Overall | 3 | 2.61 | 12.9% | 4 | 3.65 | 8.7% | 5 | 4.68 | 6.3% |

Q: codeword length in bits,
$\bar{Q}$: average codeword length in bits after entropy coding,
PC: percentage of compression achieved.

In one implementation, the Huffman coding 315 may work as follows: to the Huffman coder 315 may line up the normalized quantized measurements $\{\bar{b}_i\}_{1 \leq i < M}$ to form a set of nodes 317, each node associated with a normalized measurement value $\bar{b}_i$. At each iterative step, the Huffman coder may link two nodes with the least measurement values to generate a new node associated with the sum of the two measurement values 320. For example, at first round, there are M nodes in line, and if $\bar{b}_1$ and $\bar{b}_2$ are the two least measurement values, the two nodes associated with $\bar{b}_1$ and $\bar{b}_2$, respectively, may be combined to generate a new node associated with a new value $(\bar{b}_1+\bar{b}_2)$. In one implementation, at every stage when the node combination process is done, if there are more than one node left in the row, then the node combination process may be iteratively implemented; if there is only one node left in the row, the iterative node combination process is finished, and the Huffman coder may assign 0/1 value to the generated Huffman encoding tree 323.

For example, in one implementation, if there is a set of 4 measurements {0.4, 0.35, 0.2, 0.05}, the Huffman encoding tree generation may be similar to the form as illustrated in FIG. 3A. The generated Huffman tree may then be read backwards, from bottom to top, assigning different bits to different branches. The Huffman coder may then obtain a binary codeword for each of the initial M node (measurement) based on the 0/1 values assigned to the Huffman encoding tree 325. In this example, the final Huffman code for {0.4, 0.35, 0.2, 0.05} is 0, 10, 110 and 111.

Figure 3B:
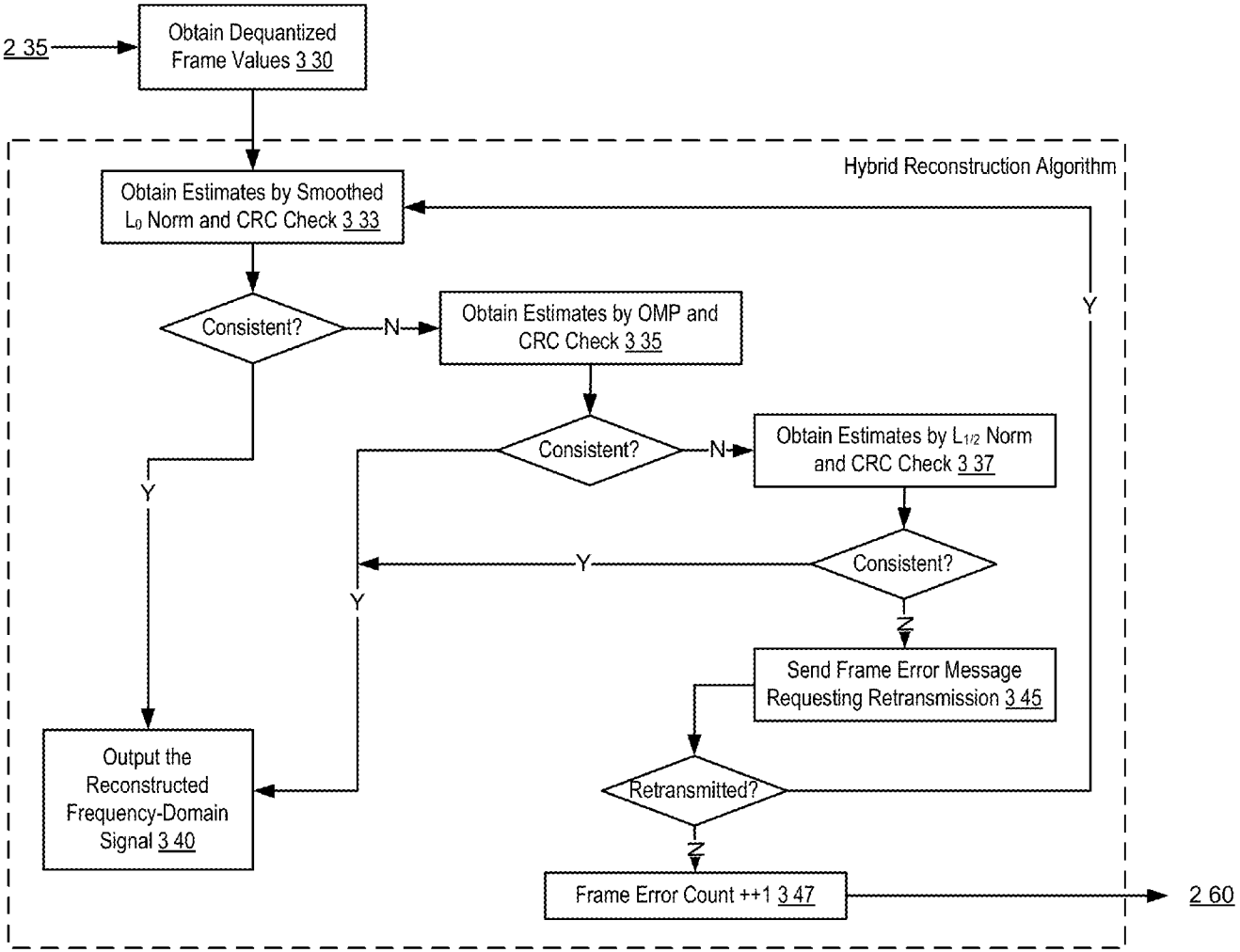
FIG. 3B is of a logic flow diagram illustrating a hybrid reconstruction method of a received audio signal within embodiments of the SS-Audio.

FIG. 3B provides a logic flow diagram illustrating a hybrid reconstruction approach of a received audio signal within embodiments of the SS-Audio. In one embodiment, subsequent to obtaining dequantized measurement values 330, the SS-Audio may obtain estimates based on compressed sensing as discussed in FIGS. 1 and 2B, employing a smoothed $L_o$ norm (the hamming distance) together with CRC check 333. In one implementation, if the $L_o$ norm based reconstruction is consistent with the CRC check, the SS-Audio may output the reconstructed frequency-domain parameters 340 as decoded signal. In another implementation, if the CRC check detects inconsistency, the SS-Audio may repeat the reconstruction by orthogonal matching pursuit (OMP), as further discussed in "Signal recovery from partial information via orthogonal matching pursuit" by J. Tropp and A. Gilbert, 2005, which is expressly incorporated herein by reference. If the OMP based reconstruction is consistent with the CRC check, the SS-Audio may adopt the OMP based reconstruction results. Otherwise, if not consistent with the CRC check, the SS-Audio may then repeat the reconstruction but with $L_{1/2}$ norm based approach 337. The SS-Audio may then determine whether the $L_{1/2}$ norm based reconstruction is consistent with the CRC check: if yes, adopt as reconstruction parameters; if not, send a frame error message to the transmitter, requesting for retransmission 345, as discussed in FIG. 2B. In one implementation, if the there is frame error but no retransmission, the SS-Audio may record it as a frame error 347. In this case, in order for the hybrid approach to fail, all three of the other approaches (OMP, $L_o$ norm and $L_{1/2}$ norm) must fail. As such, the hybrid approach may provide superior error performance over the other three approaches.

It is to be noted that the hybrid approach discussed herein may comprise a variety of sparse reconstruction approaches, and is not limited to the OMP, $L_o$ norm and $L_{1/2}$ norm approaches as discussed previously.

In one implementation, the SS-Audio may employ the smoothed $L_o$ norm approach, and then run the others if this fails in order to minimize the induced complexity. In an alternative implementation, the SS-Audio may construct the hybrid reconstruction approach in different orders.

Figure 4A:
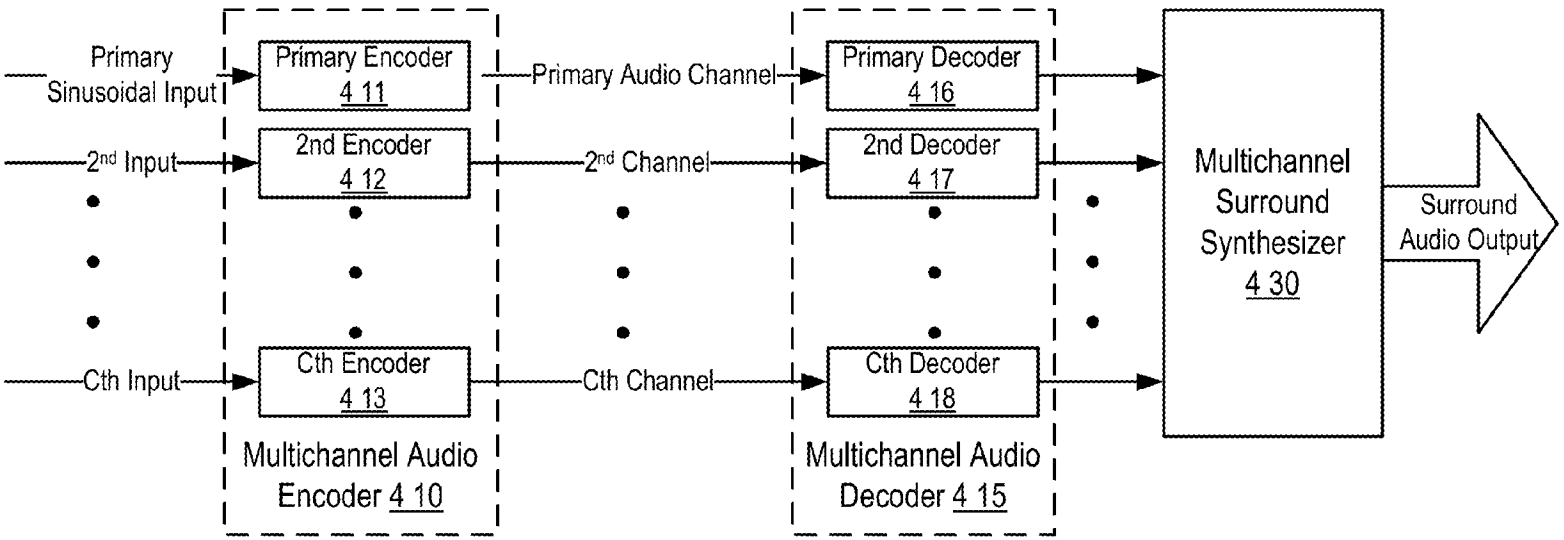
FIGS. 4A-B are of block diagrams illustrating exemplar overviews of encoding and decoding multi-channel audio signals within embodiments of the SS-Audio.
Figure 4B:
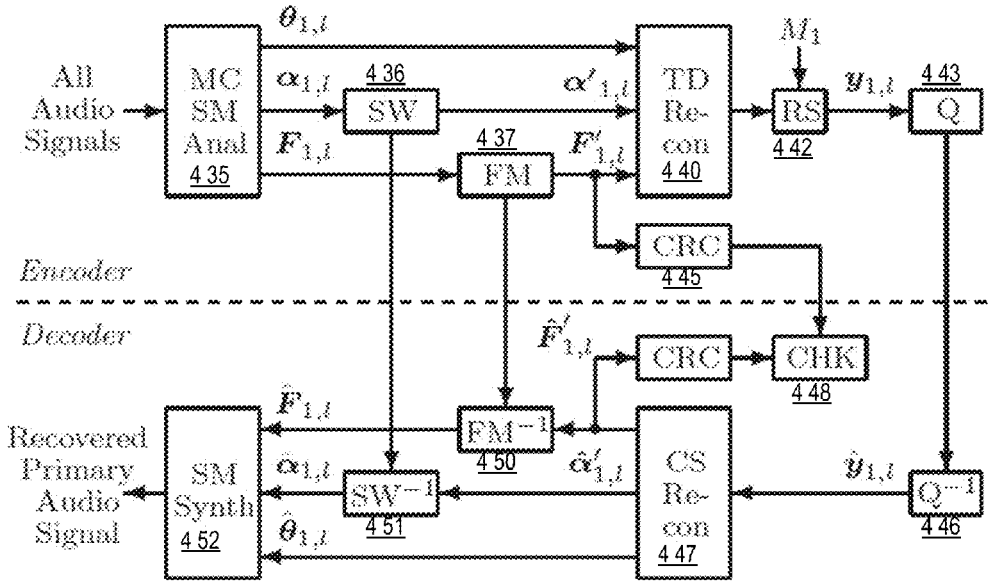
Figure 4B:
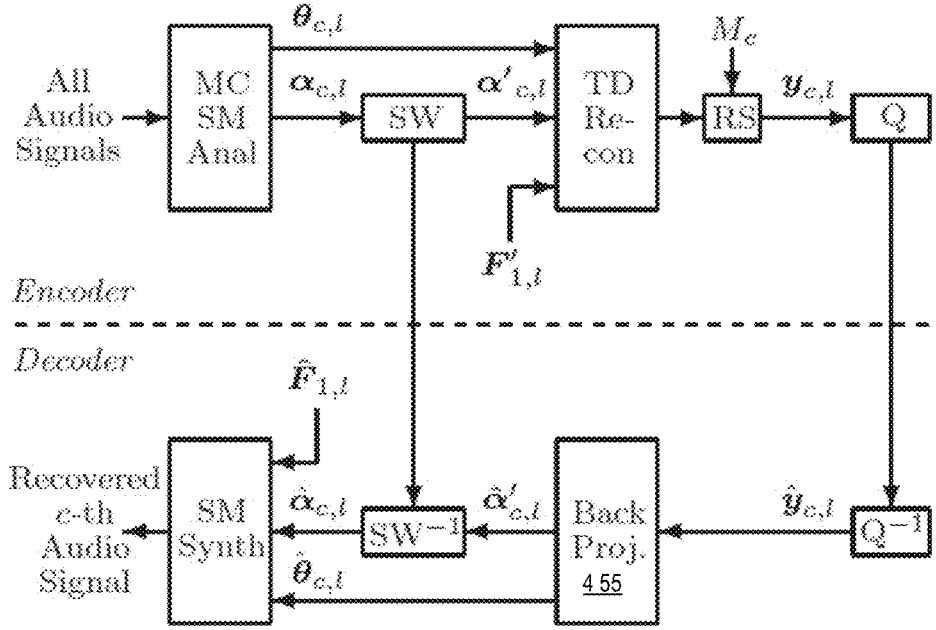

FIGS. 4A-B provide block diagrams illustrating exemplar overviews of encoding and decoding multi-channel audio signals within embodiments of the SS-Audio. In one embodiment, the SS-Audio may receive audio signal inputs from multiple channels at a multi-channel audio encoder 410. In one implementation, one of the signal channel may be referenced as a primary input, which may be encoded at a primary encoder 411, and 2nd input signal may be encoded at a 2nd encoder 412, the C-th input signal being encoded at a C-th encoder 413, and so on. In one implementation, the multiple signals may be transmitted via independent channels to a multi-channel audio decoder 415, which may decode the primary audio signal t a primary decoder 416, and the 2nd signal at the 2nd decoder 417, the C-th signal at the C-th decoder 418, respectively. In one implementation, the SS-Audio may pass the decoded multi-channel audio signals to a multi-channel surround synthesizer 430 to produce a surround audio output. For example, the SS-Audio may employ stereo surround synthesizer such as, but not limited to Logitech Z-5500 THX-Certified 5.1 Digital Surround Sound Speaker System, Sharp HTSB200 2.1 Sound Bar Audio System, and/or the like.

In one embodiment, the encoding and decoding processes of the multi-channel audio signals are shown in FIG. 4B. In one embodiment, the primary audio signal may be encoded and decoded in a similar manner to that of a monophonic audio signal, as illustrated in FIG. 1. In one implementation, the multi-channel audio signal may be passed through a psychoacoustic sinusoidal modelling block 435 to obtain the sinusoidal parameters $\{F_{1,l}, \alpha_{1,l}, \theta_{1,l}\}$ for the l-th frame of the primary channel, as will be further illustrated in FIG. 5B. In one implementation, the obtained sinusoids may go through "pre-conditioning" phase where the amplitudes are whitened (SW 436) and the frequencies remapped (FM 437) to generate modified sinusoidal parameters $\{F'_{1,l}, \alpha'_{1,l}, \theta'_{1,l}\}$. In one implementation, the modified sinusoidal parameters may be re-transformed into a time domain signal 440, from which $M_1$ samples are randomly selected (RS 442). These random measurements may then be quantized to Q bits by a uniform scalar quantizer (Q 443), and sent over the transmission channel along with the side information from the spectral whitening, frequency mapping and cyclic redundancy check (CRC 445) blocks.

In one embodiment, at the primary audio decoder, the bit stream representing the random measurements may be returned to sample values in the dequantizer block ($Q^{-1}$ 446), and then passed to the reconstruction block 447, which outputs an estimate of the modified sinusoidal parameters $\{\hat{F}_{1,l}, \hat{\alpha}_{1,l}, \hat{\theta}_{1,l}\}$. In one implementation, if the CRC detector (CHK 448) determines that the block has been correctly reconstructed, the effects of the spectral whitening and frequency mapping are removed by ($SW^{-1}$ 451) and ($FM^{-1}$ 452), respectively, to obtain an estimate of the original sinusoid parameters $\{\hat{F}_{1,l}, \hat{\alpha}_{1,l}, \hat{\theta}_{1,l}\}$. The reconstructed original sinusoid parameters of the primary audio signal $\{\hat{F}_{1,l}, \hat{\alpha}_{1,l}, \hat{\theta}_{1,l}\}$ may then be passed to the sinusoidal model resynthesis block 452 to generate a recovered primary audio signal in the time domain. In another implementation, if the block has not been correctly reconstructed as detected by CRC, then the current frame may be either retransmitted or interpolated, as previously discussed.

In one embodiment, as shown in part (b) of FIG. 4B, the encoding and decoding for the c-th audio signal (a non-primary audio signal) may be similar to that of the primary audio, but simpler as the psychoacoustic analysis (as discussed in FIG. 5B) generates same frequency indices for all channels. For example, in one implementation, the c-th encoder may obtain frequency indices from the primary encoder, $$F_{c,l}=F_{1,l}\ c=2, 3, \ldots, C,$$

$$F'_{c,l}=F'_{1,l}\ c=2, 3, \ldots, C,$$

In another implementation, the c-th decoder may obtain reconstructed frequency indices from the primary decoder $$\hat{F}_{c,l}=\hat{F}_{1,l}\ c=2, 3, \ldots, C,$$

$$\hat{F}'_{c,l}=F'_{1,l}\ c=2, 3, \ldots, C,$$

In one implementation, as shown in FIG. 4B. (b), the encoding and decoding process of the c-th audio signal may not include a frequency mapping/unmapping blocks as the c-th audio encoder/decoder may obtain frequency indices from the primary audio encoder/decoder.

In one implementation, the signal reconstruction at the c-th decoder may be reduced to a back-projection approach 455. For example, as previously presented, if the c-th channel measurement process is represented in matrix form:

$$y_{c,l}=\Phi_{c,l}\Psi X_{c,l}$$

where $y_{c,l}$, $\Phi_{c,l}$ and $X_{c,l}$ denote the c-th channel versions of $y_l$, $\Phi_l$ and $X_l$ as discussed in FIG. 1, respectively. In one implementation, $\Psi_F$ denotes the columns of matrix $\Psi$ chosen corresponding to $F_{1,l}$, and $X^F{}_{c,l}$ be the rows of $X_{c,l}$ chosen corresponding to $F_{1,l}$, then $$y_{c,l}=\Phi_{c,l}\Psi_F X^F{}_{c,l},$$

which may then be rewritten as $$X_{c,l}{}^F=(\Phi_{c,l}\Psi_F)^\dagger y_{c,l},$$

wherein $(B)^\dagger$ denotes the Moore-Penrose pseudo-inverse of a matrix B, defined as $(B)^\dagger=(B^H B)^{-1}B^H$ with $B^H$ denoting the conjugate transpose of B.

In one implementation, the SS-Audio may generate an estimate $\hat{X}_{c,l}{}^{\hat{F}}$ for $X_{c,l}{}^F$ for a non-primary channel at the c-th decoder using:

$$\hat{X}_{c,l}{}^{\hat{F}}=(\Phi_{c,l}\Psi_{\hat{F}})^\dagger \hat{y}_{c,l},$$

which has a reduced complexity compared to reconstructing the primary audio signal as previously discussed.

In one implementation, the SS-Audio may utilize the primary audio channel to determine whether or not an FRE occurs. In that case, the number of random measurements required for the other (C−1) audio channels may be significantly less than that for the primary channel, and thus $M_c<M_1$, c=2, 3, . . . C. In one implementation, decreasing $M_c$ may decrease the signal-to-distortion ratio, in which case the human perception of the audio sound is much less sensitive to than the effect of FREs. As such, in one implementation, SS-Audio may treat the primary channel as the best quality channel, with the other (C−1) being of reduced quality.

In an alternative implementation, the SS-Audio may send the sum and/or differences of the audio signals of all channels instead of audio per actual channel independently, which allows the recovery of the original channels with a more even quality between the primary channel and other channels.

FIG. 5A provides a logic flow diagram illustrating an overview of encoding and decoding multi-channel audio signals within embodiments of the SS-Audio. In one embodiment, the SS-Audio may receive multi-channel audio signals 505, and obtain sinusoidal parameters, e.g., the sinusoids and the noise component, 508. For example, this may be completed by psychoacoustic multi-channel analysis as further illustrated in FIG. 5B.

In one implementation, the SS-Audio may encode a primary channel audio signal in a similar manner as that of encoding a monophonic audio signal, as discussed in FIG. 2A 510, which may provide frequency indices 515 for encoding non-primary channel audio signals 520. The encoded bit streams, comprising both the primary channel audio signal and the non-primary channel audio signals, together with side information, may be sent to the transmission channel, and/or a decoder at the receiver 525.

In one embodiment, the SS-Audio may receive the encoded signals in independent channels, and decode the primary audio signal in a manner similar to that of decoding a monophonic signal, as discussed in FIG. 2B, 520. The primary decoder of the SS-Audio may obtain reconstructed frequency indices from the primary decoder 520, and recover non-primary channel signals 545. For example, in one implementation, the SS-Audio may generate estimates of c-th channel parameters 535 based on the obtained frequency indices by back projection, as discussed in FIG. 4B. The recovered multi-channel audio signals may be sent for output 550.

FIG. 5B provides a logic flow diagram illustrating psychoacoustic multi-channel analysis of multi-channel signals within embodiments of the SS-Audio.

In one embodiment, the SS-Audio may employ an iterative psychoacoustic analysis approach for the received multi-channel signals. In one implementation, at each iteration step counted as i, the SS-Audio may select a sinusoidal component frequency that is optimal for all C channels, as well as channel-specific amplitudes and phases.

For example, in one implementation, for each input audio channel c (including both the primary and non-primary channels), the SS-Audio may calculate a FFT of the remaining signal components 560 after the i-th iteration, denoted as $R_{i,c}(w)$, where w denotes the frequency variable. In one implementation, the SS-Audio may further calculate a frequency weighting value 562, denoted as $A_{i,c}(w)$.

The frequency weighting value may be calculated in a variety of ways.

In one implementation, $A_{i,c}(w)$ may be determined in a manner taken into consideration that for the multi-channel audio the different channels have different binaural attributes in the reproduction. For example, in transform coding, a common problem may be caused by Binaural Masking Level Difference (BMLD); and sometimes quantization noise that is masked in monaural reproduction is detectable because of binaural release.

In one implementation, the SS-Audio may conduct separate masking analysis, e.g., calculating individual $A_{i,c}(w)$ based on the masker of channel c for each signal separately, as BMLD noise unmasking may provides sufficient performance in sound quality with headphone reproduction.

In another implementation, when the SS-Audio employs loudspeaker reproduction, the SS-Audio may use the masker of the sum signal of all channel signals to obtain $A_{i,c}(w)$ for all c. In an alternative implementation, the SS-Audio may take power summation of the other signals' attenuated maskers to the masker of channel c by:

$$A_{i,c}(w) = 1 \Big/ \left( M_{i,c}(w) + \sum_k w_k M_{i,k}(w) \right)$$

where $M_{i,c}(w)$ indicates the masker energy, $w_k$ denotes the estimated attenuation (panning) factor that was varied heuristically, and k iterates through all channel signals excluding c. In an alternative implementation, the frequency weighting value $A_{i,c}(w)$ may be calculated as the inverse of the current masking threshold energy of channel c.

In one implementation, at the i-th iteration, the SS-Audio may obtain a triad of optimal sinusoidal component frequency, amplitudes and phases which minimize the perceptual distortion measure 566, which may be defined as:

$$D_i = \sum_c \int A_{i,c}(w) |R_{i,c}(w)|^2 dw,$$

where each channel contributes to obtaining the final measure.

In one implementation, the obtained optimal sinusoidal component may be added to the set of multi-channel sinusoidal model after the i-th iteration, and the SS-Audio may evaluate the residual signal components 570. For example, in one embodiment, if the total power of the residual signal components is greater than a threshold 573, the SS-Audio may be proceed with the (i+1)-th iteration 575. If not, the SS-Audio may complete the iterations and output the generated sinusoidal component parameters 578 as parameters for the multi-channel sinusoidal model. In one implementation, the psychoacoustic analysis may force all channels to share the same frequency indices.

In a further embodiment, the SS-Audio may determine noise components for the multi-channel inputs, by subtracting the determined multi-channel sinusoidal parameters from the original input signals.

In another embodiment, the SS-Audio may employ perceptual matching pursuit analyses to determine the model parameters of each frame, e.g., the amplitude, frequency, phase of the received frame, represented as the triad $\{F_l, \alpha_l, \theta_l\}$ as introduced in FIG. 1A. For example, in one implementation, an example perceptual matching pursuit analyis is further discussed in "Multichannel Matching Pursuit and Applications to Spatial Audio Coding" by M. Goodwin, published in Asilomar Conf. on Signals, Systems and Computers, October 2006, the entire disclosure of which is expressly incorporated herein by reference.

FIGS. 6A-G provide diagrams illustrating performances of an example SS-Audio system with in embodiments of the SS-Audio. In this example, the SS-Audio system adopts K=10 sinusoid components per frame and an N=256-point FFT; the audio signals are sampled at 22 kHz with a 10 ms window and 50% overlapping between frames; and around 10,000 frames of the audio data are received and processed. It should be noted that, any of a variety of other parameters and configurations may be employed within various embodiments of the SS-Audio.

Figure 6A:
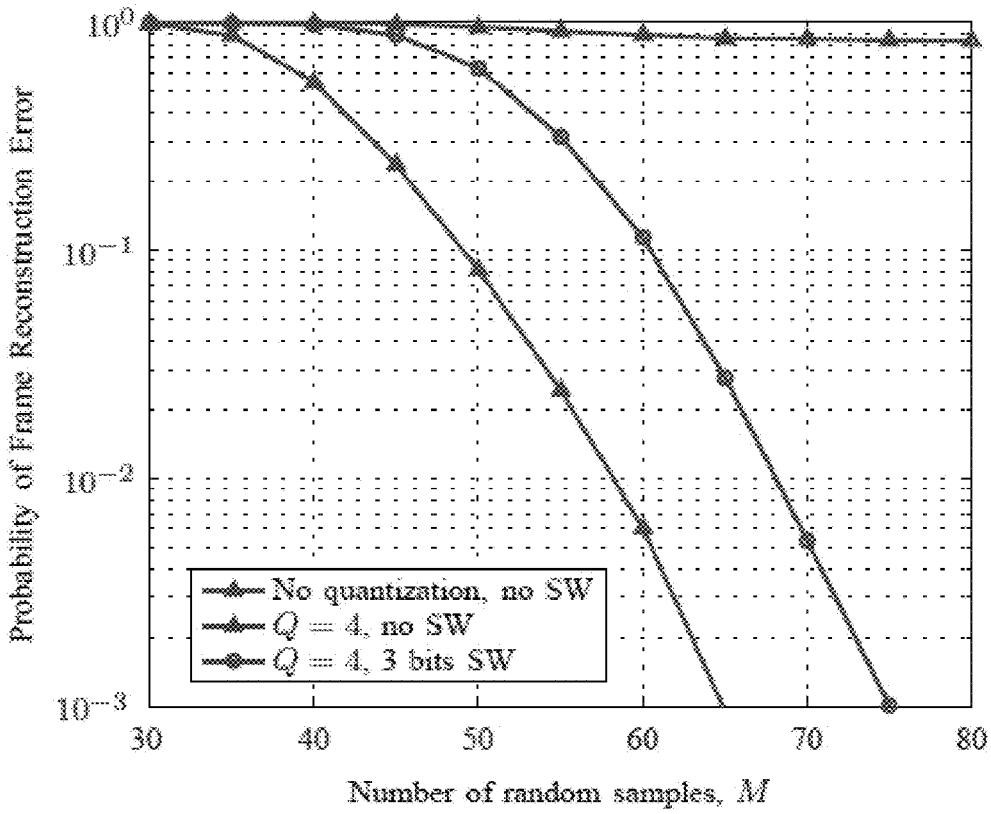
FIGS. 6A-G are of diagrams illustrating performances of an example SS-Audio system within embodiments of the SS-Audio.

In one implementation, FIG. 6A illustrates the probability of frame reconstruction error versus the number of random measurements per frame for three scenarios: no quantization and no spectral whitening, Q=4 bits quantization and no spectral whitening, and Q=4 bits quantization and 3 bits for spectral whitening. As shown in FIG. 6A, when the M samples are quantized at the encoder, the probability of frame reconstruction error may increase due to the additional error induced by the quantization process, as illustrated by the "Q=4, no SW" curve, which may in turn require a greater number M of samples to maintain the frame error performance. In one implementation, the SS-Audio may employ spectral whitening to improve the error performance, as illustrated by the "Q=4, 3 bits SW" curve, which reduces frame errors induced by quantization with 3 bits spectral whitening.

Figure 6B:
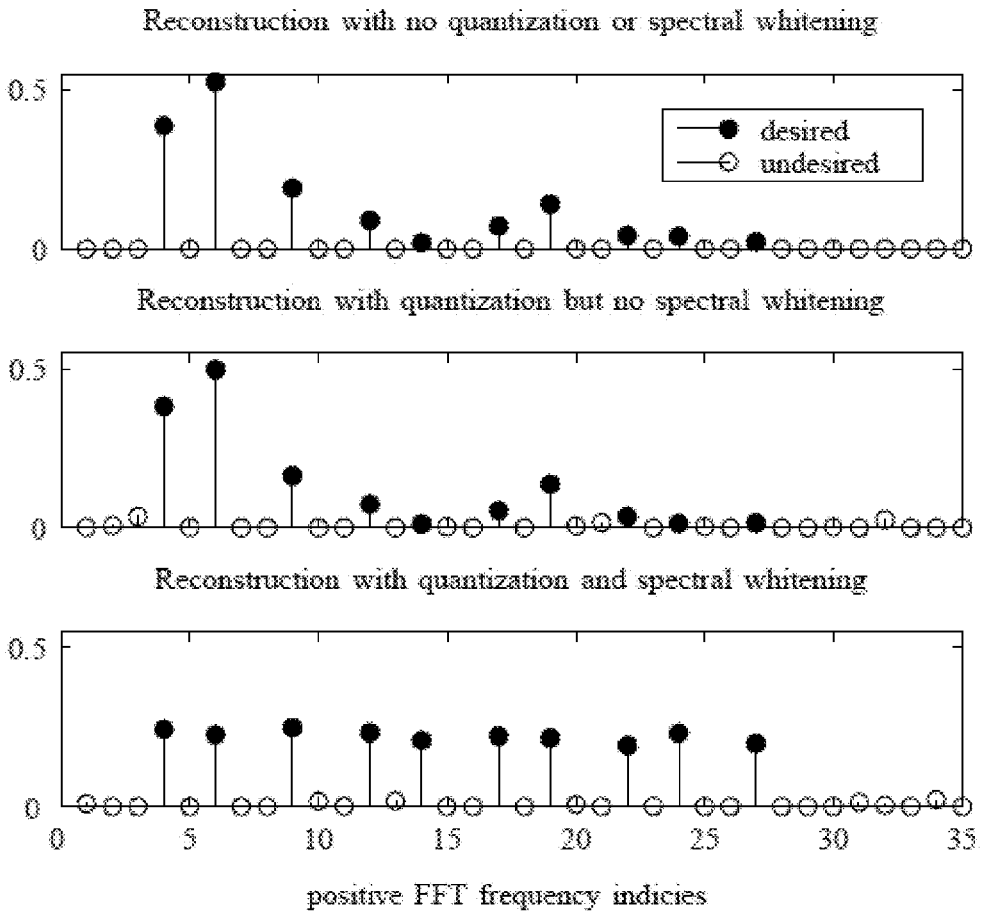

In one implementation, as the quantization is performed in the time domain, it has an effect similar to adding noise to all of the frequencies in the recovered $\hat{X}_l$, during the reconstruction, the SS-Audio may select the K largest components of recovered $\hat{X}_l$ and reset the remaining components as zero. FIG. 6B illustrates the reconstruction process within embodiments of the SS-Audio. The top plot of FIG. 6B shows the reconstruction without quantization, and the desired components are the K largest values in the reconstruction. The middle plot of FIG. 6B shows the effect of 4-bit quantization, where some of the undesired components may be greater than the desired ones, which may induce a FRE. The bottom plot of FIG. 6B shows the positive FFT frequency indices after reconstruction with a 3-bit spectral whitening at the encoder, which may reduces FREs occurred in determining desired and undesired frequency indices after reconstruction. In this example, the 3-bit whitening may incur an overhead of approximately 3K bits.

Figure 6C:
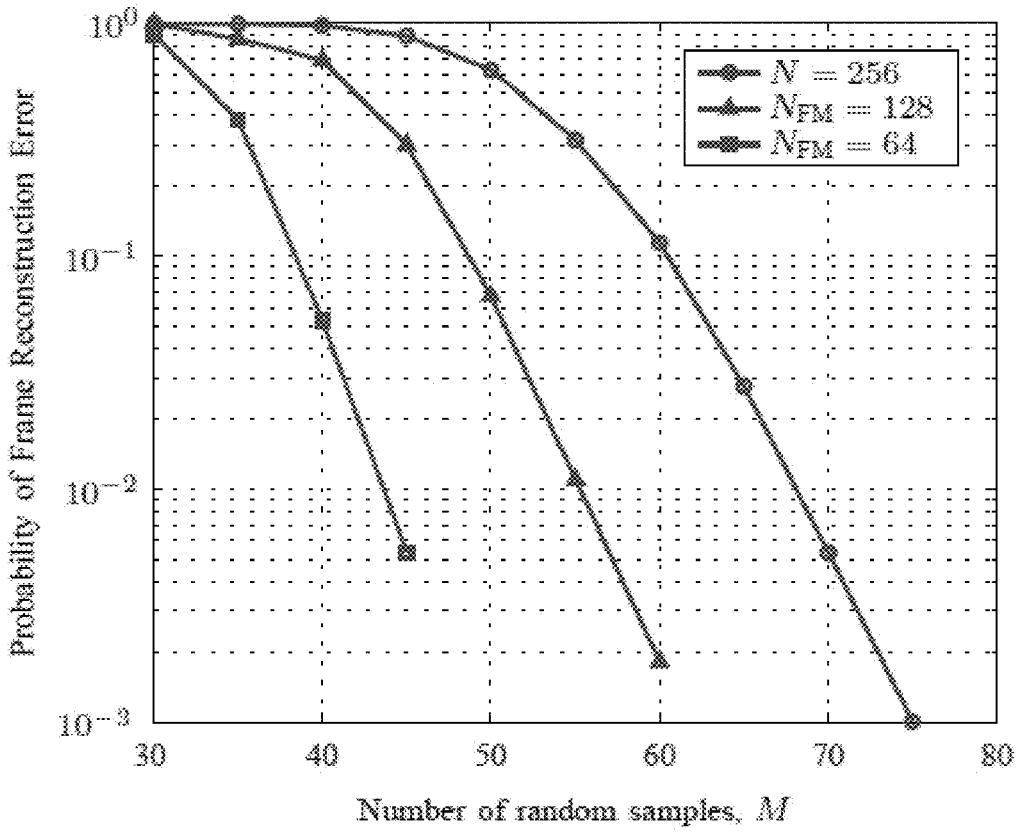

FIG. 6C illustrates the probability of frame reconstruction error versus the number of random measurements per frame for various values of frequency mapping, with 4-bit quantization of the random measurements, and 3 bits for spectral whitening. In this example, 85% of the 10,000 frames could be mapped by a frequency mapping factor $C_{FM}$ equal to 4, giving an $N_{FM}$=64. A shown in FIG. 6C, the SS-Audio may need fewer samples for a given frame error probability for various values of $N_{FM}$.

Figure 6D:
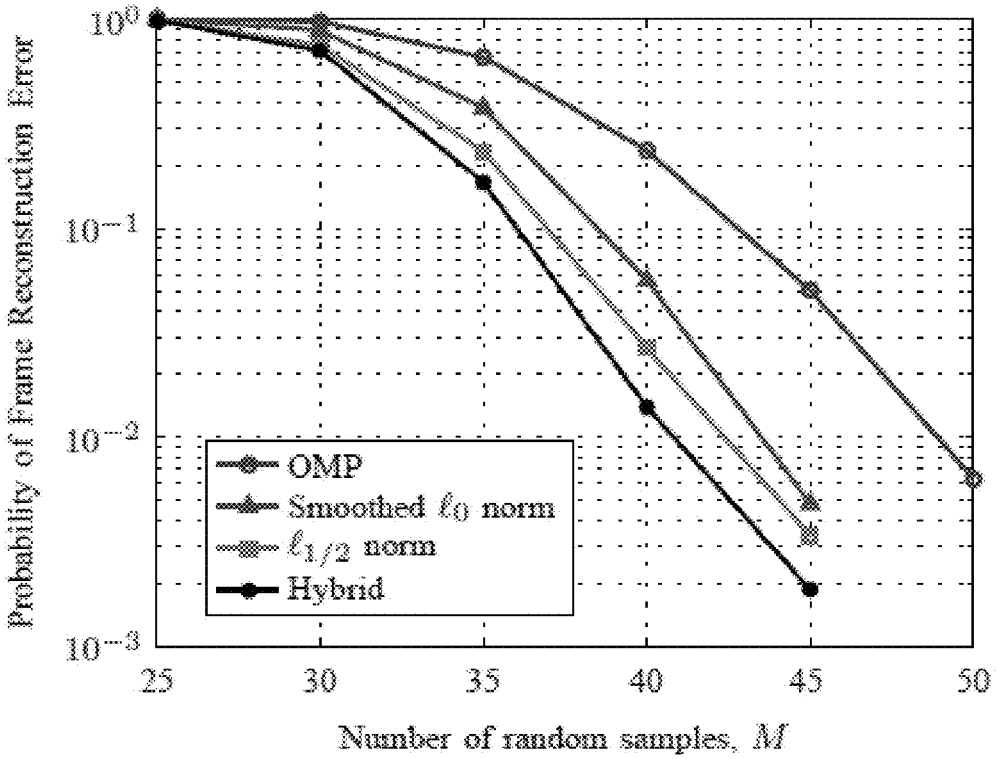

FIG. 6D illustrates the probability of frame reconstruction error versus the number of random measurements per frame for different reconstruction approaches, with 4-bit quantization of the random measurements, 3 bits for spectral whitening, and $N_{FM}$=64. In this example, the error performances of different reconstruction approaches, e.g., the OMP, the smoothed $L_o$ norm, the $L_{1/2}$ norm, and the Hybrid approach as discussed in FIG. 3B are compared. The plot shows the Hybrid approach which employs all the other three approaches has the best performance in this example.

Figure 6E:
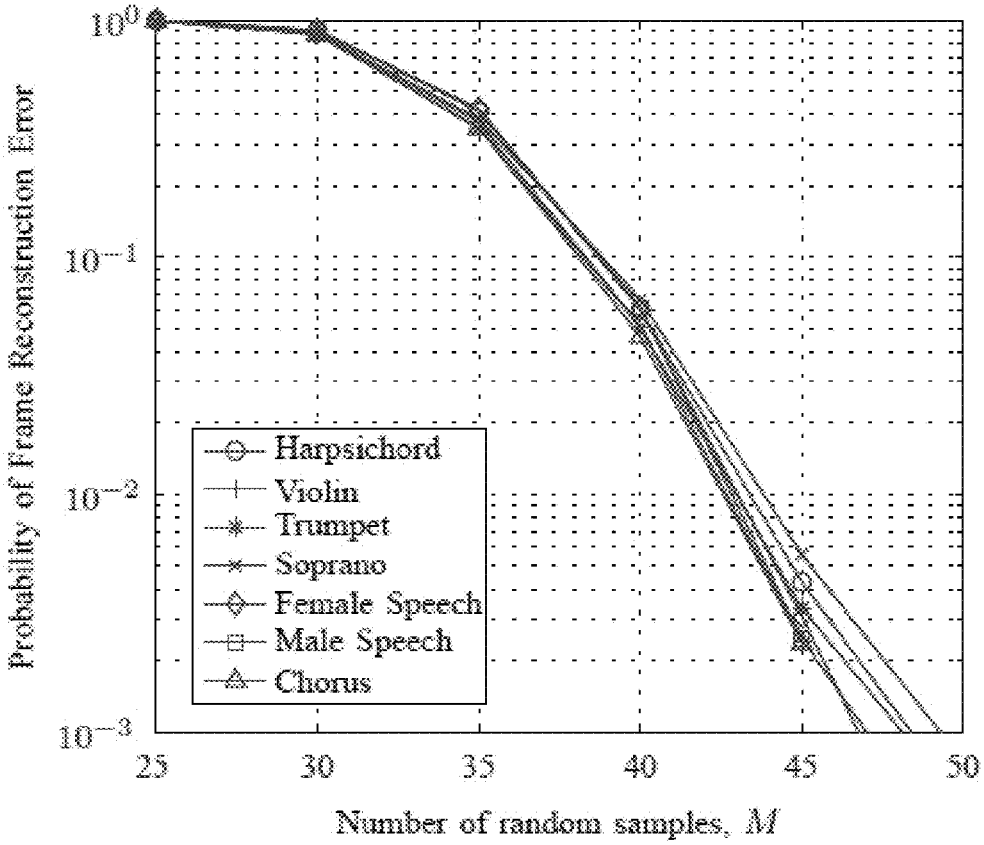

FIG. 6E illustrates the probability of frame reconstruction error versus the number of random measurements for individual signals, with 4-bit quantization of the random measurements, 3 bits for spectral whitening, $N_{FM}$=64, Q=4 bit quantization, and the smoothed $L_o$ norm reconstruction approach. In this example, as shown in FIG. 6E, the frame error probability varies from about 0.008 to 0.018 at a random measurement number of M=43.

Figure 6F:
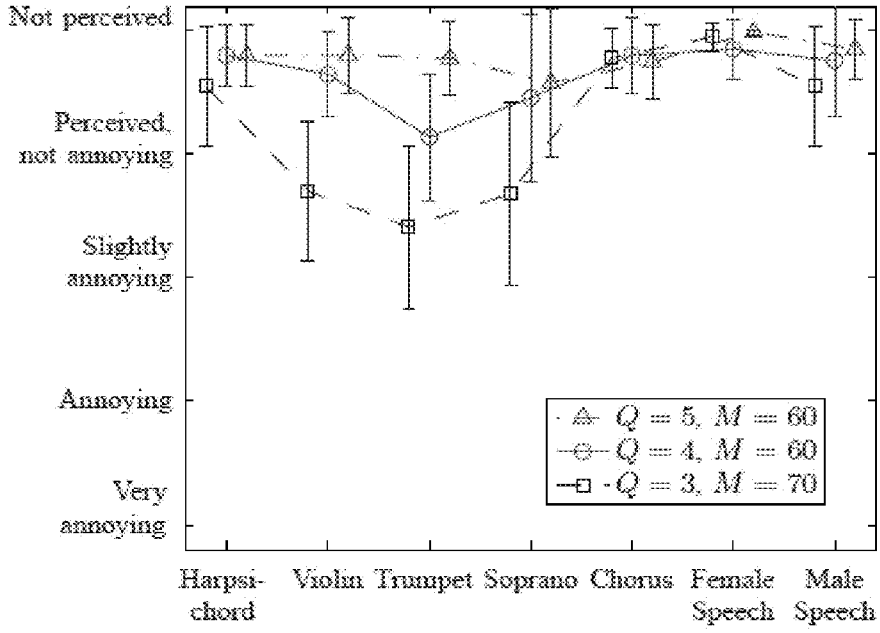
Figure 6F:
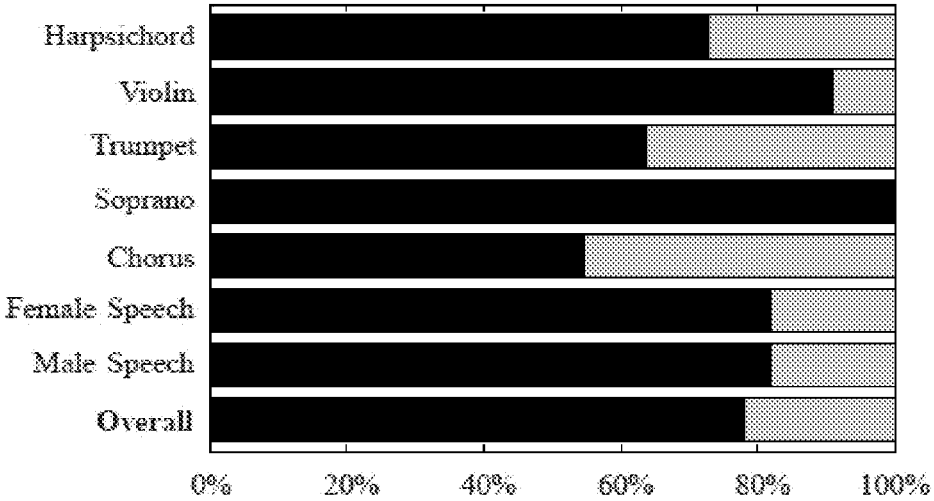

FIG. 6F illustrates the resulting audio quality of the example SS-Audio system discussed above within embodiments of the SS-Audio. For example, in one implementation, two types of monophonic listening performance demonstrations are performed, where volunteers are presented with audio files using high-quality headphones in a quiet office room.

In one implementation, the coded signals were compared against the originally recorded signals using a 5-scale grading system (from 1-"very annoying" audio quality compared to the original, to 5-"not perceived" difference in quality, as shown in FIG. 6F. (i)). In one implementation, there are no anchor signals used. The following seven signals were used (signals 1-7): harpsichord, violin, trumpet, soprano, chorus, female speech, male speech. as shown in FIG. 6F. (ii).

In one implementation, the sinusoidal error signal is obtained and added to the sinusoidal part, so that audio quality is judged without placing emphasis on the stochastic component. The signals are downsampled to 22 kHz, so that the stochastic component does not affect the resulting quality to a large degree. This is because the stochastic component is particularly dominant in higher frequencies, thus its effect would be more evident in the 44.1 kHz than the 22 kHz sampling rate.

In one implementation, the second type of performance demonstration employs sinusoidal analysis/synthesis window of 10 ms, with 50% overlapping, where listeners may indicate their preference among a pair of audio signals at each time, in terms of quality. One quality and one preference performance demonstration may be conducted to evaluate the quality of the audio signals when modelled by N=256-point FFT and K=10 sinusoids per frame. Eleven volunteers participated in this pair of listening performance demonstrations, whose listening results of the quality performance demonstration are shown in FIG. 6F.(ii).

In one implementation, the resulting bitrates per audio frame for the example of FIG. 6F are given in Table II.

TABLE II

PARAMETERS TO ACHIEVE A PROBABILITY OF FRE OF APPROXIMATELY $10^{-3}$, FOR N = 256, NFM = 128, K = 10

| $N_{FM}$ | Q | M | raw bitrate | CRC | SW | final bitrate | per sinusoid |
|---|---|---|---|---|---|---|---|
| 128 | 5 | 60 | 300 | 11 | 50 | 369 | 36.9 |
| 128 | 4 | 60 | 240 | 11 | 50 | 319 | 31.9 |
| 128 | 3 | 70 | 210 | 11 | 50 | 279 | 27.9 |

In Table II, three sets of M and Q are given (per audio frame) that achieve a frame error probability of approximately $10^{-3}$, for the N=256, $N_{FM}$=128, and K=10 case with differing values of Q. The overhead consists of the extra bits required for the CRC, the frequency mapping and the spectral whitening. In one implementation, 5 bits for spectral whitening may be used.

Table III further presents the bitrates for a frame error probability of approximately $10^{-2}$ corresponding to the curves in FIG. 6C. In one implementation, as shown in Table III, the overhead incurred from spectral whitening and frequency mapping may be higher than accounted for by significant reductions in M, resulting in overall lower bitrates.

TABLE III

PARAMETERS THAT ACHIEVE A PROBABILITY OF FRE OF APPROXIMATELY $10^{-2}$ WITH N = 256 AND K = 10

| $N_{FM}$ | Q | M | raw bitrate | CRC | SW | final bitrate | per sinusoid |
|---|---|---|---|---|---|---|---|
| 256 | 4 | 68 | 272 | 0 | 30 | 310 | 31.0 |
| 128 | 4 | 55 | 220 | 11 | 30 | 269 | 26.9 |
| 64 | 4 | 43 | 172 | 23 | 30 | 233 | 23.3 |

In one implementation, as shown in FIG. 6F, the quality for the Q=5, M=60 and Q=4, M=60 cases remains well above 4.0 grade (e.g., perceived as "not annoying"). It is noted that the above parameters chosen for the example illustrated in FIG.

6F are for illustrative purpose only, and a variety of other choices of parameters may be employed by the SS-Audio.

In one implementation, the SS-Audio may achieve a low bitrate for the $N_{FM}$=64 case, which may be at under 21 bits per sinusoid if entropy coding and the hybrid reconstruction approach are used.

Figure 6G:
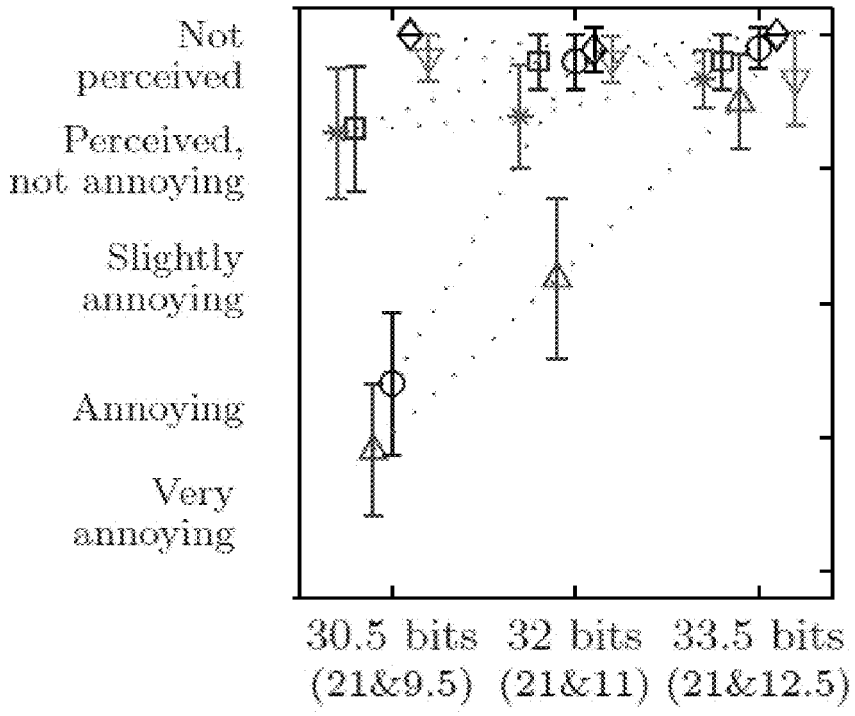

FIG. 6G illustrates results of quality rating performance demonstrations for various stereo signals from four channel inputs within embodiment of the SS-Audio. In one implementation, a listening performance demonstration is held comprising the following six stereo signals: male and female speech, male and female chorus, trumpet and violin, a cappella singing, jazz and rock. The bits per frame per sinusoid are given for each of the two transmitted audio channels.

In one example, the sinusoidal model analysis is performed using K=80 sinusoid components per frame and an N=2048-point FFT. All the audio signals are sampled at 22 kHz with a 20 ms window and 50% overlapping between frames. In one implementation, the SS-Audio may use 4-bit quantization of the random measurements and the parameters given in Table IV.

TABLE IV

PARAMETERS USED TO ENCODE THE SIGNALS USED IN THE LISTENING PERFORMANCE DEMONSTRATIONS, AND THEIR ASSOCIATED PER-FRAME BITRATES.

| $N_{FM}$ | Q | M | raw bitrate | CRC | SW | final bitrate | per sinusoid |
|---|---|---|---|---|---|---|---|
| 1 | 240 | 960 | 8 | 320 | 1694 | 21.2 | 1 |
| 2 | 210 | 840 | 0 | 160 | 1000 | 12.5 | 2 |
| 2 | 180 | 720 | 0 | 160 | 880 | 11.0 | 2 |
| 2 | 150 | 600 | 0 | 160 | 760 | 9.5 | 2 |

In this example, the primary channel is the sum of the left and the right channels, and the secondary channel their difference. The primary channel is set to have 4 bits per sinusoid of spectral whitening (SW) and approximately 5 bits per sinusoid for frequency mapping (FM), and 240 random measurements to achieve a frame error probability of less than $10^{-2}$, giving a required bit rate of 21.2 bits per sinusoid. The secondary channel is set to have 2 bits per sinusoid of spectral whitening and no bits were required for frequency mapping. The number of random measurements for the secondary channel are {150, 180, 210}, giving {9.5, 11.0, 12.5} bits per sinusoid respectively.

In one implementation, as shown in FIG. 6G, the notation e.g. 21 & 9.5 bits in the x-axis, corresponds to using 21 bits for the primary channel and 9.5 bits for the secondary channel per sinusoid, while 30.5 is the total number of bits per sinusoid used (the summation of all channels). In one implementation, retransmission at FRE occurrences is utilized in this example.

Figure 7A:
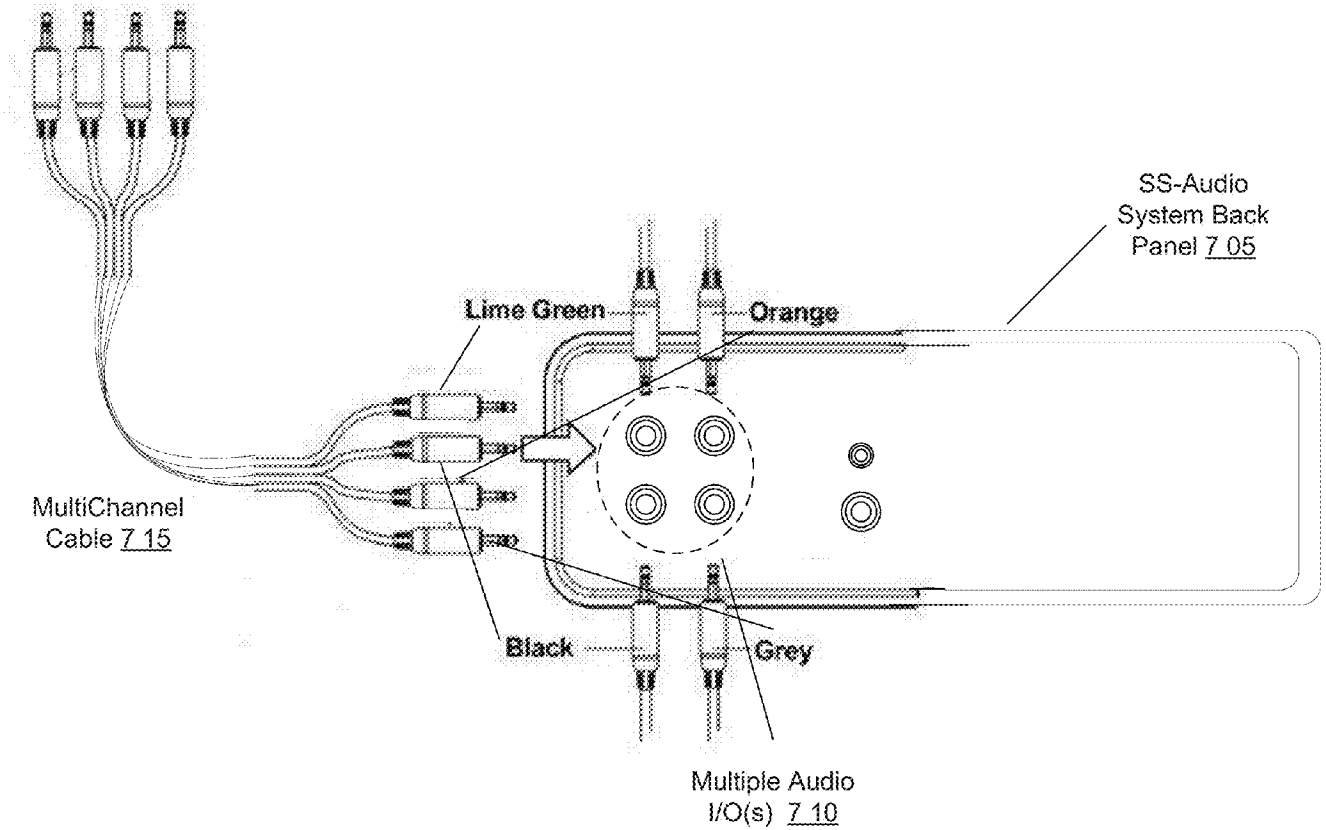
FIGS. 7A-C are of diagrams illustrating example components and system configurations of a SS-Audio system within embodiments of the SS-Audio.
Figure 7B:
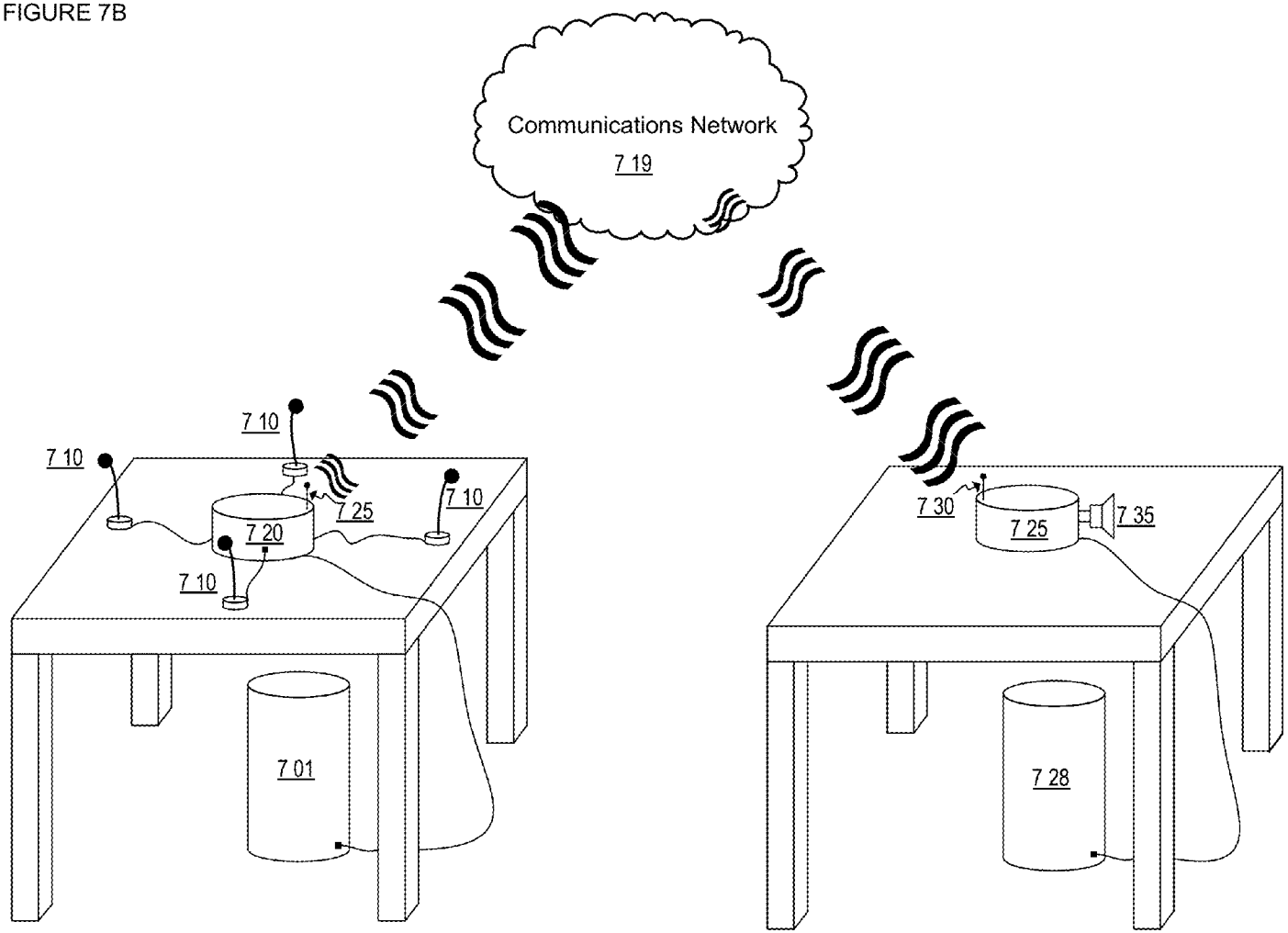
Figure 7C:
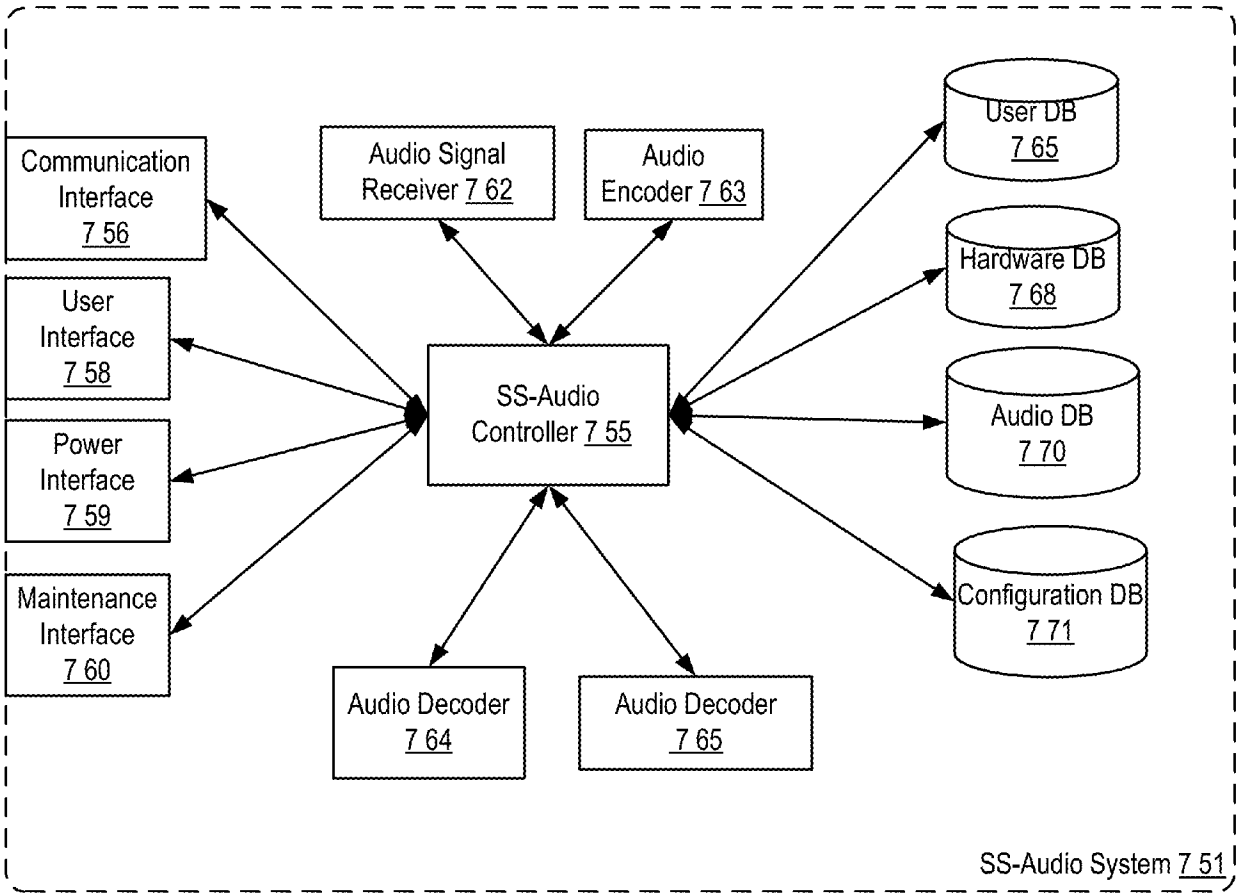

FIGS. 7A-C provide diagrams illustrating example components and system configurations of a SS-Audio system within embodiments of the SS-Audio. As shown in FIG. 7A, in one implementation, the SS-Audio may include a sound reproduction system, such as a media player device, a television, and/or the like. In one implementation, the back panel of a SS-Audio system 705 may comprise multiple audio input/output ports 710. For example, in one implementation, the SS-Audio system may be connected to a reproduction device, such as, but not limited to a headset, a surround sound speaker, and/the like, by a multi-channel cable 715. In one implementation, the multi-channel cable may contain cables connecting to plugs with different colors representing different audio channels, such as the lime green plug, the orange plug, the black plug, and the grey plug as shown in FIG. 7A.

FIG. 7B shows an illustration of one implementation of an example of wireless multi-channel SS-Audio application in one embodiment of APT the SS-Audio. In one embodiment, the SS-Audio system 701 (aspects of an example SS-Audio system are discussed in greater detail below in FIG. 7C) at a first location may be communicatively coupled to an audio acquisition and/or recording module 720, configurable to receive, record, store and/or the like audio information, such as from one or more microphones, telephone receivers, and/or other audio sensors, transducers, and/or the like 710. In one implementation, the received audio signals may be processed by the SS-Audio system 701 in accordance with the methods described herein, possibly with additional encoding, compression, and/or the like as needed or desired within a given implementation.

In one implementation, the audio system 701 may produce an encoded monophonic audio signal, or multi-channel audio signals along with corresponding side information, may then be transmitted via a transmitter 725, to a receiver 730 at a second site by means of a communications network 719. In one implementation, the SS-Audio system 728 at the receiving location may reconstruct the original audio signal from the received signal and side information. The receiving SS-Audio system may be coupled to a module 725 configured to playback the reconstructed audio signals, such as via an integrated speaker 735.

In one implementation, the SS-Audio system may be employed at a single first location from which the audio signals are acquired and a single second location to which the processed signals are sent. In another implementation, one or more audio source locations may be coupled to one or more audio destination locations. Furthermore, a single location may serve both as a source of audio information as well as a destination for processed audio signals acquired at other locations. For example, in one implementation, the SS-Audio may be configured for several teleconferencing applications, wherein SS-Audio systems at various locations may be configured both to record/process audio from the teleconference participants at each location and to decode/playback audio received from other locations.

It should further be noted that, though the implementation of a teleconferencing application illustrated in FIGS. 7A-B employ a cable connection and a wireless communications network, respectively, any of a variety of other communications methods and/or conduits may be employed within various embodiments of the SS-Audio.

FIG. 7C illustrates an implementation of SS-Audio system components in one embodiment of SS-Audio operation. A SS-Audio device 751 may contain a number of functional components and/or data stores. A SS-Audio controller 205 may serve a central role in some embodiments of SS-Audio operation, serving to orchestrate the reception, generation, and distribution of data and/or instructions to, from and between target device(s) and/or client device(s) via SS-Audio components and in some instances mediating communications with external entities and systems.

In one embodiment, the SS-Audio controller 755 may be housed separately from other components and/or databases within the SS-Audio system, while in another embodiment, some or all of the other modules and/or databases may be housed within and/or configured as part of the SS-Audio controller. Further detail regarding implementations of SS-Audio controller operations, modules, and databases is provided below.

In one embodiment, the SS-Audio Controller 755 may be coupled to one or more interface components and/or modules. In one embodiment, the SS-Audio Controller may be coupled to a user interface (UI) 758, a communication interface 756, a maintenance interface 760, and a power interface 759. The user interface 758 may be configured to receive user inputs and display application states and/or other outputs. The UI may, for example, allow a user to adjust SS-Audio system settings, select communication methods and/or protocols, configure audio encoding and decoding parameters, initiate audio transmissions, engage device application features, identify possible receiver/transmitter and/or the like.

In various implementations, the communication interface 756 may, for example, serve to configure data into application, transport, network, media access control, and/or physical layer formats in accordance with a network transmission protocol, such as, but not limited to FTP, TCP/IP, SMTP, Short Message Peer-to-Peer (SMPP) and/or the like. For example, the communication interface 756 may be configured for receipt and/or transmission of data to a SS-Audio receiver and/or network database. The communication interface 756 may further be configurable to implement and/or translate Wireless Application Protocol (WAP), VoIP and/or the like data formats and/or protocols. The communication interface 756 may further house one or more ports, jacks, antennas, and/or the like to facilitate wired and/or wireless communications with and/or within the SS-Audio system.

In one implementation, the user interface 758 may include, but not limited to devices such as, keyboard(s), mouse, stylus (es), touch screen(s), digital display(s), and/or the like. In one embodiment, the maintenance interface 760 may, for example, configure regular inspection and repairs, receive system upgrade data, report system behaviors, and/or the like. In one embodiment, the power interface 759 may, for example, connect the SS-Audio controlled 755 to an embedded battery and/or an external power source.

In one embodiment, the SS-Audio Controller may further be coupled to a variety of module components, such as, but not limited to an audio signal receiver component 762, an audio encoder component 763, an audio transmitter component 764, an audio decoder component 765, and/or the like. In one implementation, the audio signal receiver 762 and the audio signal transmitter 764 may be configured to transmit/receive audio signals. For example, the audio signal receiver 762, and the audio signal transmitter 764 may be equipped with, and/or connected to an audio jack, wireless antenna, and/or the like. In one implementation, the audio encoder 763 may encode received analog audio signals into digital audio packets for transmission, and the audio decoder 765 may decode such digital audio packets into original analog audio signals, as discussed in FIGS. 1, 2A and 4A-B.

Numerous data transfer protocols may also be employed as SS-Audio connections, for example, TCP/IP and/or higher protocols such as HTTP post, FTP put commands, and/or the like. In one implementation, the communications module 230 may comprise web server software equipped to configure application state data for publication on the World Wide Web. Published application state data may, in one implementation, be represented as an integrated video, animation, rich internet application, and/or the like configured in accordance with a multimedia plug-in such as Adobe Flash. In another implementation, the communications module 230 may comprise remote access software, such as Citrix, Virtual Network Computing (VNC), and/or the like equipped to configure application state data for viewing on a remote client (e.g., a remote display device).

In one implementation, the SS-Audio controller 755 may further be coupled to a plurality of databases configured to store and maintain SS-Audio data. A user database 765 may contain information pertaining to account information, contact information, profile information, identities of hardware devices, Customer Premise Equipments (CPEs), and/or the like associated with users, audio file information, application license information, and/or the like. A hardware database 768 may contain information pertaining to hardware devices with which the SS-Audio system may communicate, such as but not limited to user devices, display devices, target devices, Email servers, user telephony devices, CPEs, gateways, routers, user terminals, and/or the like. The hardware database 768 may specify transmission protocols, data formats, and/or the like suitable for communicating with hardware devices employed by any of a variety of SS-Audio affiliated entities. In one implementation, the audio database 770 may contain information pertaining to audio files, audio transmission parameters, audio encoding and decoding parameters, and/or the like. In one implementation, the configuration database 771 may contain information pertaining to SS-Audio parameter configurations, such as, but not limited to frame length, overlapping rate, bitrate, channel selections, and/or the like.

In one embodiment, the SS-Audio databases may be implemented using various standard data-structures, such as an array, hash, (linked) list, struct, structured text file (e.g., XML), table, and/or the like. For example, in one implementation, the XML for an Audio Profile in the audio database 770 may take a form similar to the following example:

```
<Audio>
  <General>
    <User_ID> 123-45-6789 </User_ID>
    <Hardware ID> SDASFK45632_iPhone 3.0 </Hardware ID>
    <File_Name> AudioTest </FileName>
    <Format> WMV media file </Format>
    <Audio_Length> 12'35" </Audio_Length>
    <Channel__1> on </Channel__1>
    <Channel__2> off </Channel__2>
    . . .
  </General>
  <Processing_Parameters>
    <FFT_Size> 256 </FFT_Size>
    <Frame_Length> 20 ms </Frame_Length>
    <Overlapping> 0.5 </Overlapping>
    . . .
  <Processing_Parameters>
  . . .
</Audio>
```

Figure 8:
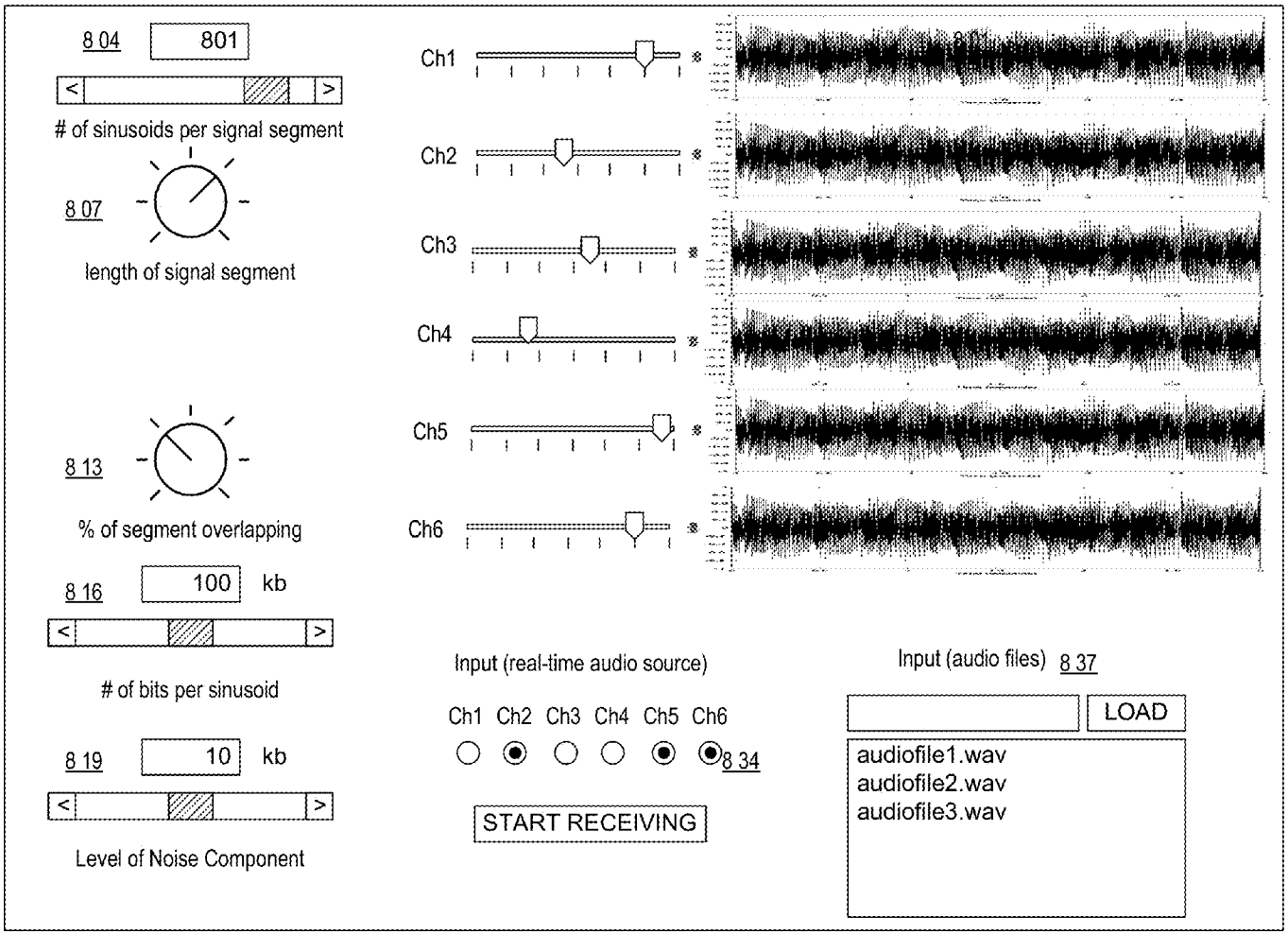
FIG. 8 is of a schematic example screen shot within embodiments of the SS-Audio.

FIG. 8 shows an schematic example user interface (UI) of the encoding side in one embodiment of the SS-Audio. The implementation shown includes a display screen 801 which may be configurable to display an audio signal, signal sample, time-domain and/or frequency-domain signal, error signal, and/or the like, as well as system messages, menus, and/or the like. In one implementation, the display screen may admit touch-screen inputs. The illustrated UI further includes a variety of interface widgets configurable to receive user inputs and/or selections which may be stored and/or may alter, influence, and/or control various aspects of the SS-Audio. A slider widget is shown at 804, by which the number of sinusoids used to model each signal segment may be controlled. In an alternative implementation, the SS-Audio may determine the number of sinusoids from the received input audio signal.

A dial widget is shown at 807, by which the segment length of a signal frame (e.g., 20 milliseconds) for each signal segment may be controlled. A dial widget 813 may be used to set the percentage of segment overlapping between frames (e.g., 30%). A slider widget is shown at 816, by which the number of bits per sinusoid used in the sinusoidal model may be varied. A slider widget is shown at 819, by which the noise tolerance level, e.g., the threshold in psychoacoustic analysis as discussed in FIG. 5B, may be varied.

In one embodiment, slider widgets are also shown at 821-826, by which the bitrate (in kbps) of each input channel 1, 2, 3, 4, 5 or 6 may respectively be adjusted. The waveform of each input signal may be illustrated in a display window next to the sliding widget associated with the channel. In one implementation, the user may set a primary channel for multi-channel input by configuring the bitrate of each channel. In an alternative implementation, the SS-Audio may suggest default values of channel bitrates by analyzing the input signals and determining a primary audio channel. It should be noted that the illustrated implementation allows only up to six channels, however an alternative implementation may allow as many channels as needed and/or desired by a SS-Audio system, administrator, and/or the like.

At 834, a series of radio buttons allow a user to specify one or more channels from which audio data feeds, real-time recordings, and/or the like may be received. The illustrated UI implementation also includes, at 837, a window in which to specify one or more audio data files to load for SS-Audio processing. In one implementation, the SS-Audio may support a variety of audio file formats, such as but not limited to AAC, MP3, WAV, WMA, and/or the like.

SS-Audio Controller

Figure 9:
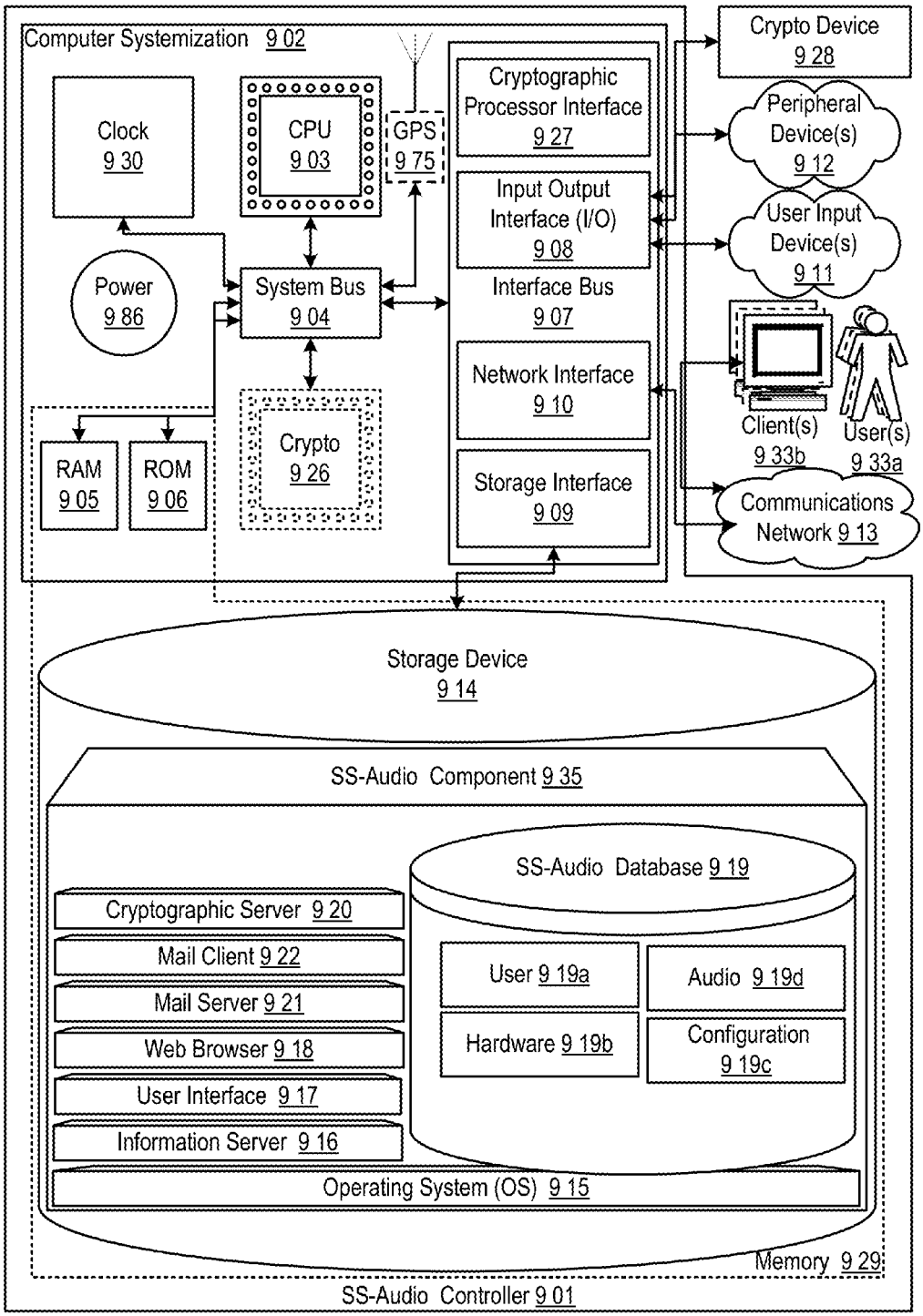
FIG. 9 is of a block diagram illustrating embodiments of the SS-Audio controller.

FIG. 9 illustrates inventive aspects of a SS-Audio controller 901 in a block diagram. In this embodiment, the SS-Audio controller 901 may serve to aggregate, process, store, search, serve, identify, instruct, generate, match, and/or facilitate interactions with a computer through audio codec technologies, and/or other related data.

Typically, users, which may be people and/or other systems, may engage information technology systems (e.g., computers) to facilitate information processing. In turn, computers employ processors to process information; such processors 903 may be referred to as central processing units (CPU). One form of processor is referred to as a microprocessor. CPUs use communicative circuits to pass binary encoded signals acting as instructions to enable various operations. These instructions may be operational and/or data instructions containing and/or referencing other instructions and data in various processor accessible and operable areas of memory 929 (e.g., registers, cache memory, random access memory, etc.). Such communicative instructions may be stored and/or transmitted in batches (e.g., batches of instructions) as programs and/or data components to facilitate desired operations. These stored instruction codes, e.g., programs, may engage the CPU circuit components and other motherboard and/or system components to perform desired operations. One type of program is a computer operating system, which, may be executed by CPU on a computer; the operating system enables and facilitates users to access and operate computer information technology and resources. Some resources that may be employed in information technology systems include: input and output mechanisms through which data may pass into and out of a computer; memory storage into which data may be saved; and processors by which information may be processed. These information technology systems may be used to collect data for later retrieval, analysis, and manipulation, which may be facilitated through a database program. These information technology systems provide interfaces that allow users to access and operate various system components.

In one embodiment, the SS-Audio controller 901 may be connected to and/or communicate with entities such as, but not limited to: one or more users from user input devices 911; peripheral devices 912; an optional cryptographic processor device 928; and/or a communications network 913.

Networks are commonly thought to comprise the interconnection and interoperation of clients, servers, and intermediary nodes in a graph topology. It should be noted that the term "server" as used throughout this application refers generally to a computer, other device, program, or combination thereof that processes and responds to the requests of remote users across a communications network. Servers serve their information to requesting "clients." The term "client" as used herein refers generally to a computer, program, other device, user and/or combination thereof that is capable of processing and making requests and obtaining and processing any responses from servers across a communications network. A computer, other device, program, or combination thereof that facilitates, processes information and requests, and/or furthers the passage of information from a source user to a destination user is commonly referred to as a "node." Networks are generally thought to facilitate the transfer of information from source points to destinations. A node specifically tasked with furthering the passage of information from a source to a destination is commonly called a "router." There are many forms of networks such as Local Area Networks (LANs), Pico networks, Wide Area Networks (WANs), Wireless Networks (WLANs), etc. For example, the Internet is generally accepted as being an interconnection of a multitude of networks whereby remote clients and servers may access and interoperate with one another.

The SS-Audio controller 901 may be based on computer systems that may comprise, but are not limited to, components such as: a computer systemization 902 connected to memory 929.

Computer Systemization

A computer systemization 902 may comprise a clock 930, central processing unit ("CPU(s)" and/or "processor(s)" (these terms are used interchangeable throughout the disclosure unless noted to the contrary)) 903, a memory 929 (e.g., a read only memory (ROM) 906, a random access memory (RAM) 905, etc.), and/or an interface bus 907, and most frequently, although not necessarily, are all interconnected and/or communicating through a system bus 904 on one or more (mother)board(s) 902 having conductive and/or otherwise transportive circuit pathways through which instructions (e.g., binary encoded signals) may travel to effect communications, operations, storage, etc. Optionally, the computer systemization may be connected to an internal power source 986. Optionally, a cryptographic processor 926 may be connected to the system bus. The system clock typically has a crystal oscillator and generates a base signal through the computer systemization's circuit pathways. The clock is typically coupled to the system bus and various clock multipliers that will increase or decrease the base operating frequency for other components interconnected in the computer systemization. The clock and various components in a computer systemization drive signals embodying information throughout the system. Such transmission and reception of instructions embodying information throughout a computer systemization may be commonly referred to as communications. These communicative instructions may further be transmitted, received, and the cause of return and/or reply communications beyond the instant computer systemization to: communications networks, input devices, other computer systemizations, peripheral devices, and/or the like. Of course, any of the above components may be connected directly to one another, connected to the CPU, and/or organized in numerous variations employed as exemplified by various computer systems.

The CPU comprises at least one high-speed data processor adequate to execute program components for executing user and/or system-generated requests. Often, the processors themselves will incorporate various specialized processing units, such as, but not limited to: integrated system (bus) controllers, memory management control units, floating point units, and even specialized processing sub-units like graphics processing units, digital signal processing units, and/or the like. Additionally, processors may include internal fast access addressable memory, and be capable of mapping and addressing memory 529 beyond the processor itself; internal memory may include, but is not limited to: fast registers, various levels of cache memory (e.g., level 1, 2, 3, etc.), RAM, etc. The processor may access this memory through the use of a memory address space that is accessible via instruction address, which the processor can construct and decode allowing it to access a circuit path to a specific memory address space having a memory state. The CPU may be a microprocessor such as: AMD's Athlon, Duron and/or Opteron; ARM's application, embedded and secure processors; IBM and/or Motorola's DragonBall and PowerPC; IBM's and Sony's Cell processor; Intel's Celeron, Core (2) Duo, Itanium, Pentium, Xeon, and/or XScale; and/or the like processor(s). The CPU interacts with memory through instruction passing through conductive and/or transportive conduits (e.g., (printed) electronic and/or optic circuits) to execute stored instructions (i.e., program code) according to conventional data processing techniques. Such instruction passing facilitates communication within the SS-Audio controller and beyond through various interfaces. Should processing requirements dictate a greater amount speed and/or capacity, distributed processors (e.g., Distributed SS-Audio), mainframe, multi-core, parallel, and/or super-computer architectures may similarly be employed. Alternatively, should deployment requirements dictate greater portability, smaller Personal Digital Assistants (PDAs) may be employed.

Depending on the particular implementation, features of the SS-Audio may be achieved by implementing a microcontroller such as CAST's R8051XC2 microcontroller; Intel's MCS 51 (i.e., 8051 microcontroller); and/or the like. Also, to implement certain features of the SS-Audio, some feature implementations may rely on embedded components, such as: Application-Specific Integrated Circuit ("ASIC"), Digital Signal Processing ("DSP"), Field Programmable Gate Array ("FPGA"), and/or the like embedded technology. For example, any of the SS-Audio component collection (distributed or otherwise) and/or features may be implemented via the microprocessor and/or via embedded components; e.g., via ASIC, coprocessor, DSP, FPGA, and/or the like. Alternately, some implementations of the SS-Audio may be implemented with embedded components that are configured and used to achieve a variety of features or signal processing.

Depending on the particular implementation, the embedded components may include software solutions, hardware solutions, and/or some combination of both hardware/software solutions. For example, SS-Audio features discussed herein may be achieved through implementing FPGAs, which are a semiconductor devices containing programmable logic components called "logic blocks", and programmable interconnects, such as the high performance FPGA Virtex series and/or the low cost Spartan series manufactured by Xilinx. Logic blocks and interconnects can be programmed by the customer or designer, after the FPGA is manufactured, to implement any of the SS-Audio features. A hierarchy of programmable interconnects allow logic blocks to be interconnected as needed by the SS-Audio system designer/administrator, somewhat like a one-chip programmable breadboard. An FPGA's logic blocks can be programmed to perform the function of basic logic gates such as AND, and XOR, or more complex combinational functions such as decoders or simple mathematical functions. In most FPGAs, the logic blocks also include memory elements, which may be simple flip-flops or more complete blocks of memory. In some circumstances, the SS-Audio may be developed on regular FPGAs and then migrated into a fixed version that more resembles ASIC implementations. Alternate or coordinating implementations may migrate SS-Audio controller features to a final ASIC instead of or in addition to FPGAs. Depending on the implementation all of the aforementioned embedded components and microprocessors may be considered the "CPU" and/or "processor" for the SS-Audio.

Power Source

The power source 986 may be of any standard form for powering small electronic circuit board devices such as the following power cells: alkaline, lithium hydride, lithium ion, lithium polymer, nickel cadmium, solar cells, and/or the like. Other types of AC or DC power sources may be used as well. In the case of solar cells, in one embodiment, the case provides an aperture through which the solar cell may capture photonic energy. The power cell 986 is connected to at least one of the interconnected subsequent components of the SS-Audio thereby providing an electric current to all subsequent components. In one example, the power source 986 is connected to the system bus component 904. In an alternative embodiment, an outside power source 986 is provided through a connection across the I/O 908 interface. For example, a USB and/or IEEE 1394 connection carries both data and power across the connection and is therefore a suitable source of power.

Interface Adapters

Interface bus(ses) 907 may accept, connect, and/or communicate to a number of interface adapters, conventionally although not necessarily in the form of adapter cards, such as but not limited to: input output interfaces (I/O) 908, storage interfaces 909, network interfaces 910, and/or the like. Optionally, cryptographic processor interfaces 927 similarly may be connected to the interface bus. The interface bus provides for the communications of interface adapters with one another as well as with other components of the computer systemization. Interface adapters are adapted for a compatible interface bus. Interface adapters conventionally connect to the interface bus via a slot architecture. Conventional slot architectures may be employed, such as, but not limited to: Accelerated Graphics Port (AGP), Card Bus, (Extended) Industry Standard Architecture ((E)ISA), Micro Channel Architecture (MCA), NuBus, Peripheral Component Interconnect (Extended) (PCI(X)), PCI Express, Personal Computer Memory Card International Association (PCMCIA), and/or the like.

Storage interfaces 909 may accept, communicate, and/or connect to a number of storage devices such as, but not limited to: storage devices 914, removable disc devices, and/or the like. Storage interfaces may employ connection protocols such as, but not limited to: (Ultra) (Serial) Advanced Technology Attachment (Packet Interface) ((Ultra) (Serial) ATA(PI)), (Enhanced) Integrated Drive Electronics ((E)IDE), Institute of Electrical and Electronics Engineers (IEEE) 1394, fiber channel, Small Computer Systems Interface (SCSI), Universal Serial Bus (USB), and/or the like.

Network interfaces 910 may accept, communicate, and/or connect to a communications network 913. Through a communications network 913, the SS-Audio controller is accessible through remote clients 933*b* (e.g., computers with web browsers) by users 933*a*. Network interfaces may employ connection protocols such as, but not limited to: direct connect, Ethernet (thick, thin, twisted pair 10/100/1000 Base T, and/or the like), Token Ring, wireless connection such as IEEE 802.11a-x, and/or the like. Should processing requirements dictate a greater amount speed and/or capacity, distributed network controllers (e.g., Distributed SS-Audio), architectures may similarly be employed to pool, load balance, and/or otherwise increase the communicative bandwidth required by the SS-Audio controller. A communications network may be any one and/or the combination of the following: a direct interconnection; the Internet; a Local Area Network (LAN); a Metropolitan Area Network (MAN); an Operating Missions as Nodes on the Internet (OMNI); a secured custom connection; a Wide Area Network (WAN); a wireless network (e.g., employing protocols such as, but not limited to a Wireless Application Protocol (WAP), I-mode, and/or the like); and/or the like. A network interface may be regarded as a specialized form of an input output interface. Further, multiple network interfaces 910 may be used to engage with various communications network types 913. For example, multiple network interfaces may be employed to allow for the communication over broadcast, multicast, and/or unicast networks.

Input Output interfaces (I/O) 908 may accept, communicate, and/or connect to user input devices 911, peripheral devices 912, cryptographic processor devices 928, and/or the like. I/O may employ connection protocols such as, but not limited to: audio: analog, digital, monaural, RCA, stereo, and/or the like; data: Apple Desktop Bus (ADB), IEEE 1394a-b, serial, universal serial bus (USB); infrared; joystick; keyboard; midi; optical; PC AT; PS/2; parallel; radio; video interface: Apple Desktop Connector (ADC), BNC, coaxial, component, composite, digital, Digital Visual Interface (DVI), high-definition multimedia interface (HDMI), RCA, RF antennae, S-Video, VGA, and/or the like; wireless: 802.11a/b/g/n/x, Bluetooth, code division multiple access (CDMA), global system for mobile communications (GSM), WiMax, etc.; and/or the like. One typical output device may include a video display, which typically comprises a Cathode Ray Tube (CRT) or Liquid Crystal Display (LCD) based monitor with an interface (e.g., DVI circuitry and cable) that accepts signals from a video interface, may be used. The video interface composites information generated by a computer systemization and generates video signals based on the composited information in a video memory frame. Another output device is a television set, which accepts signals from a video interface. Typically, the video interface provides the composited video information through a video connection interface that accepts a video display interface (e.g., an RCA composite video connector accepting an RCA composite video cable; a DVI connector accepting a DVI display cable, etc.).

User input devices 911 may be card readers, dongles, finger print readers, gloves, graphics tablets, joysticks, keyboards, mouse (mice), remote controls, retina readers, trackballs, trackpads, and/or the like.

Peripheral devices 912 may be connected and/or communicate to I/O and/or other facilities of the like such as network interfaces, storage interfaces, and/or the like. Peripheral devices may be audio devices, cameras, dongles (e.g., for copy protection, ensuring secure transactions with a digital signature, and/or the like), external processors (for added functionality), goggles, microphones, monitors, network interfaces, printers, scanners, storage devices, video devices, video sources, visors, and/or the like.

It should be noted that although user input devices and peripheral devices may be employed, the SS-Audio controller may be embodied as an embedded, dedicated, and/or monitor-less (i.e., headless) device, wherein access would be provided over a network interface connection.

Cryptographic units such as, but not limited to, microcontrollers, processors 926, interfaces 927, and/or devices 928 may be attached, and/or communicate with the SS-Audio controller. A MC68HC16 microcontroller, manufactured by Motorola Inc., may be used for and/or within cryptographic units. The MC68HC16 microcontroller utilizes a 16-bit multiply-and-accumulate instruction in the 16 MHz configuration and requires less than one second to perform a 512-bit RSA private key operation. Cryptographic units support the authentication of communications from interacting agents, as well as allowing for anonymous transactions. Cryptographic units may also be configured as part of CPU. Equivalent microcontrollers and/or processors may also be used. Other commercially available specialized cryptographic processors include: the Broadcom's CryptoNetX and other Security Processors; nCipher's nShield, SafeNet's Luna PCI (e.g., 7100) series; Semaphore Communications' 40 MHz Roadrunner 184; Sun's Cryptographic Accelerators (e.g., Accelerator 6000 PCIe Board, Accelerator 500 Daughtercard); Via Nano Processor (e.g., L2100, L2200, U2400) line, which is capable of performing 500+ MB/s of cryptographic instructions; VLSI Technology's 33 MHz 6868; and/or the like.

Memory

Generally, any mechanization and/or embodiment allowing a processor to affect the storage and/or retrieval of information is regarded as memory 929. However, memory is a fungible technology and resource, thus, any number of memory embodiments may be employed in lieu of or in concert with one another. It is to be understood that the SS-Audio controller and/or a computer systemization may employ various forms of memory 929. For example, a computer systemization may be configured wherein the functionality of on-chip CPU memory (e.g., registers), RAM, ROM, and any other storage devices are provided by a paper punch tape or paper punch card mechanism; of course such an embodiment would result in an extremely slow rate of operation. In a typical configuration, memory 929 will include ROM 906, RAM 905, and a storage device 914. A storage device 914 may be any conventional computer system storage. Storage devices may include a drum; a (fixed and/or removable) magnetic disk drive; a magneto-optical drive; an optical drive (i.e., Blueray, CD ROM/RAM/Recordable (R)/ReWritable (RW), DVD R/RW, HD DVD R/RW etc.); an array of devices (e.g., Redundant Array of Independent Disks (RAID)); solid state memory devices (USB memory, solid state drives (SSD), etc.); other processor-readable storage mediums; and/or other devices of the like. Thus, a computer systemization generally requires and makes use of memory.

Component Collection

The memory 929 may contain a collection of program and/or database components and/or data such as, but not limited to: operating system component(s) 915 (operating system); information server component(s) 916 (information server); user interface component(s) 917 (user interface); Web browser component(s) 918 (Web browser); database(s) 919; mail server component(s) 921; mail client component(s) 922; cryptographic server component(s) 920 (cryptographic server); the SS-Audio component(s) 935; and/or the like (i.e., collectively a component collection). These components may be stored and accessed from the storage devices and/or from storage devices accessible through an interface bus. Although non-conventional program components such as those in the component collection, typically, are stored in a local storage device 914, they may also be loaded and/or stored in memory such as: peripheral devices, RAM, remote storage facilities through a communications network, ROM, various forms of memory, and/or the like.

Operating System

The operating system component 915 is an executable program component facilitating the operation of the SS-Audio controller. Typically, the operating system facilitates access of I/O, network interfaces, peripheral devices, storage devices, and/or the like. The operating system may be a highly fault tolerant, scalable, and secure system such as: Apple Macintosh OS X (Server); AT&T Plan 9; Be OS; Unix and Unix-like system distributions (such as AT&T's UNIX; Berkley Software Distribution (BSD) variations such as FreeBSD, NetBSD, OpenBSD, and/or the like; Linux distributions such as Red Hat, Ubuntu, and/or the like); and/or the like operating systems. However, more limited and/or less secure operating systems also may be employed such as Apple Macintosh OS, IBM OS/2, Microsoft DOS, Microsoft Windows 2000/2003/3.1/95/98/CE/Millenium/NT/Vista/XP (Server), Palm OS, and/or the like. An operating system may communicate to and/or with other components in a component collection, including itself, and/or the like. Most frequently, the operating system communicates with other program components, user interfaces, and/or the like. For example, the operating system may contain, communicate, generate, obtain, and/or provide program component, system, user, and/or data communications, requests, and/or responses. The operating system, once executed by the CPU, may enable the interaction with communications networks, data, I/O, peripheral devices, program components, memory, user input devices, and/or the like. The operating system may provide communications protocols that allow the SS-Audio controller to communicate with other entities through a communications network 913. Various communication protocols may be used by the SS-Audio controller as a subcarrier transport mechanism for interaction, such as, but not limited to: multicast, TCP/IP, UDP, unicast, and/or the like.

Information Server

An information server component 916 is a stored program component that is executed by a CPU. The information server may be a conventional Internet information server such as, but not limited to Apache Software Foundation's Apache, Microsoft's Internet Information Server, and/or the like. The information server may allow for the execution of program components through facilities such as Active Server Page (ASP), ActiveX, (ANSI) (Objective–) C (++), C# and/or .NET, Common Gateway Interface (CGI) scripts, dynamic (D) hypertext markup language (HTML), FLASH, Java, JavaScript, Practical Extraction Report Language (PERL), Hypertext Pre-Processor (PHP), pipes, Python, wireless application protocol (WAP), WebObjects, and/or the like. The information server may support secure communications protocols such as, but not limited to, File Transfer Protocol (FTP); HyperText Transfer Protocol (HTTP); Secure Hypertext Transfer Protocol (HTTPS), Secure Socket Layer (SSL), messaging protocols (e.g., America Online (AOL) Instant Messenger (AIM), Application Exchange (APEX), ICQ, Internet Relay Chat (IRC), Microsoft Network (MSN) Messenger Service, Presence and Instant Messaging Protocol (PRIM), Internet Engineering Task Force's (IETF's) Session Initiation Protocol (SIP), SIP for Instant Messaging and Presence Leveraging Extensions (SIMPLE), open XML-based Extensible Messaging and Presence Protocol (XMPP) (i.e., Jabber or Open Mobile Alliance's (OMA's) Instant Messaging and Presence Service (IMPS)), Yahoo! Instant Messenger Service, and/or the like. The information server provides results in the form of Web pages to Web browsers, and allows for the manipulated generation of the Web pages through interaction with other program components. After a Domain Name System (DNS) resolution portion of an HTTP request is resolved to a particular information server, the information server resolves requests for information at specified locations on the SS-Audio controller based on the remainder of the HTTP request. For example, a request such as http://123.124.125.126/myInformation.html might have the IP portion of the request "123.124.125.126" resolved by a DNS server to an information server at that IP address; that information server might in turn further parse the http request for the "/myInformation.html" portion of the request and resolve it to a location in memory containing the information "myInformation.html." Additionally, other information serving protocols may be employed across various ports, e.g., FTP communications across port 21, and/or the like. An information server may communicate to and/or with other components in a component collection, including itself, and/or facilities of the like. Most frequently, the information server communicates with the SS-Audio database 919, operating systems, other program components, user interfaces, Web browsers, and/or the like.

Access to the SS-Audio database may be achieved through a number of database bridge mechanisms such as through scripting languages as enumerated below (e.g., CGI) and through inter-application communication channels as enumerated below (e.g., CORBA, WebObjects, etc.). Any data requests through a Web browser are parsed through the bridge mechanism into appropriate grammars as required by the SS-Audio. In one embodiment, the information server would provide a Web form accessible by a Web browser. Entries made into supplied fields in the Web form are tagged as having been entered into the particular fields, and parsed as such. The entered terms are then passed along with the field tags, which act to instruct the parser to generate queries directed to appropriate tables and/or fields. In one embodiment, the parser may generate queries in standard SQL by instantiating a search string with the proper join/select commands based on the tagged text entries, wherein the resulting command is provided over the bridge mechanism to the SS-Audio as a query. Upon generating query results from the query, the results are passed over the bridge mechanism, and may be parsed for formatting and generation of a new results Web page by the bridge mechanism. Such a new results Web page is then provided to the information server, which may supply it to the requesting Web browser.

Also, an information server may contain, communicate, generate, obtain, and/or provide program component, system, user, and/or data communications, requests, and/or responses.

User Interface

The function of computer interfaces in some respects is similar to automobile operation interfaces. Automobile operation interface elements such as steering wheels, gearshifts, and speedometers facilitate the access, operation, and display of automobile resources, functionality, and status. Computer interaction interface elements such as check boxes, cursors, menus, scrollers, and windows (collectively and commonly referred to as widgets) similarly facilitate the access, operation, and display of data and computer hardware and operating system resources, functionality, and status. Operation interfaces are commonly called user interfaces. Graphical user interfaces (GUIs) such as the Apple Macintosh Operating System's Aqua, IBM's OS/2, Microsoft's Windows 2000/2003/3.1/95/98/CE/Millenium/NT/XP/Vista/7 (i.e., Aero), Unix's X-Windows (e.g., which may include additional Unix graphic interface libraries and layers such as K Desktop Environment (KDE), mythTV and GNU Network Object Model Environment (GNOME)), web interface libraries (e.g., ActiveX, AJAX, (D)HTML, FLASH, Java, JavaScript, etc. interface libraries such as, but not limited to, Dojo, jQuery(UI), MooTools, Prototype, script.aculo.us, SWFObject, Yahoo! User Interface, any of which may be used and) provide a baseline and means of accessing and displaying information graphically to users.

A user interface component 917 is a stored program component that is executed by a CPU. The user interface may be a conventional graphic user interface as provided by, with, and/or atop operating systems and/or operating environments such as already discussed. The user interface may allow for the display, execution, interaction, manipulation, and/or operation of program components and/or system facilities through textual and/or graphical facilities. The user interface provides a facility through which users may affect, interact, and/or operate a computer system. A user interface may communicate to and/or with other components in a component collection, including itself, and/or facilities of the like. Most frequently, the user interface communicates with operating systems, other program components, and/or the like. The user interface may contain, communicate, generate, obtain, and/or provide program component, system, user, and/or data communications, requests, and/or responses.

Web Browser

A Web browser component 918 is a stored program component that is executed by a CPU. The Web browser may be a conventional hypertext viewing application such as Microsoft Internet Explorer or Netscape Navigator. Secure Web browsing may be supplied with 128 bit (or greater) encryption by way of HTTPS, SSL, and/or the like. Web browsers allowing for the execution of program components through facilities such as ActiveX, AJAX, (D)HTML, FLASH, Java, JavaScript, web browser plug-in APIs (e.g., FireFox, Safari Plug-in, and/or the like APIs), and/or the like. Web browsers and like information access tools may be integrated into PDAs, cellular telephones, and/or other mobile devices. A Web browser may communicate to and/or with other components in a component collection, including itself, and/or facilities of the like. Most frequently, the Web browser communicates with information servers, operating systems, integrated program components (e.g., plug-ins), and/or the like; e.g., it may contain, communicate, generate, obtain, and/or provide program component, system, user, and/or data communications, requests, and/or responses. Of course, in place of a Web browser and information server, a combined application may be developed to perform similar functions of both. The combined application would similarly affect the obtaining and the provision of information to users, user agents, and/or the like from the SS-Audio enabled nodes. The combined application may be nugatory on systems employing standard Web browsers.

Mail Server

A mail server component 921 is a stored program component that is executed by a CPU 903. The mail server may be a conventional Internet mail server such as, but not limited to sendmail, Microsoft Exchange, and/or the like. The mail server may allow for the execution of program components through facilities such as ASP, ActiveX, (ANSI) (Objective–) C (++), C# and/or .NET, CGI scripts, Java, JavaScript, PERL, PHP, pipes, Python, WebObjects, and/or the like. The mail server may support communications protocols such as, but not limited to: Internet message access protocol (IMAP), Messaging Application Programming Interface (MAPI)/Microsoft Exchange, post office protocol (POP3), simple mail transfer protocol (SMTP), and/or the like. The mail server can route, forward, and process incoming and outgoing mail messages that have been sent, relayed and/or otherwise traversing through and/or to the SS-Audio.

Access to the SS-Audio mail may be achieved through a number of APIs offered by the individual Web server components and/or the operating system.

Also, a mail server may contain, communicate, generate, obtain, and/or provide program component, system, user, and/or data communications, requests, information, and/or responses.

Mail Client

A mail client component 922 is a stored program component that is executed by a CPU 903. The mail client may be a conventional mail viewing application such as Apple Mail, Microsoft Entourage, Microsoft Outlook, Microsoft Outlook Express, Mozilla, Thunderbird, and/or the like. Mail clients may support a number of transfer protocols, such as: IMAP, Microsoft Exchange, POP3, SMTP, and/or the like. A mail client may communicate to and/or with other components in a component collection, including itself, and/or facilities of the like. Most frequently, the mail client communicates with mail servers, operating systems, other mail clients, and/or the like; e.g., it may contain, communicate, generate, obtain, and/or provide program component, system, user, and/or data communications, requests, information, and/or responses. Generally, the mail client provides a facility to compose and transmit electronic mail messages.

Cryptographic Server

A cryptographic server component 920 is a stored program component that is executed by a CPU 903, cryptographic processor 926, cryptographic processor interface 927, cryptographic processor device 928, and/or the like. Cryptographic processor interfaces will allow for expedition of encryption and/or decryption requests by the cryptographic component; however, the cryptographic component, alternatively, may run on a conventional CPU. The cryptographic component allows for the encryption and/or decryption of provided data. The cryptographic component allows for both symmetric and asymmetric (e.g., Pretty Good Protection (PGP)) encryption and/or decryption. The cryptographic component may employ cryptographic techniques such as, but not limited to: digital certificates (e.g., X.509 authentication framework), digital signatures, dual signatures, enveloping, password access protection, public key management, and/or the like. The cryptographic component will facilitate numerous (encryption and/or decryption) security protocols such as, but not limited to: checksum, Data Encryption Standard (DES), Elliptical Curve Encryption (ECC), International Data Encryption Algorithm (IDEA), Message Digest 5 (MD5, which is a one way hash function), passwords, Rivest Cipher (RC5), Rijndael, RSA (which is an Internet encryption and authentication system that uses an algorithm developed in 1977 by Ron Rivest, Adi Shamir, and Leonard Adleman), Secure Hash Algorithm (SHA), Secure Socket Layer (SSL), Secure Hypertext Transfer Protocol (HTTPS), and/or the like. Employing such encryption security protocols, the SS-Audio may encrypt all incoming and/or outgoing communications and may serve as node within a virtual private network (VPN) with a wider communications network. The cryptographic component facilitates the process of "security authorization" whereby access to a resource is inhibited by a security protocol wherein the cryptographic component effects authorized access to the secured resource. In addition, the cryptographic component may provide unique identifiers of content, e.g., employing and MD5 hash to obtain a unique signature for an digital audio file. A cryptographic component may communicate to and/or with other components in a component collection, including itself, and/or facilities of the like. The cryptographic component supports encryption techniques allowing for the secure transmission of information across a communications network to enable the SS-Audio component to engage in secure transactions if so desired. The cryptographic component facilitates the secure accessing of resources on the SS-Audio and facilitates the access of secured resources on remote systems; i.e., it may act as a client and/or server of secured resources. Most frequently, the cryptographic component communicates with information servers, operating systems, other program components, and/or the like. The cryptographic component may contain, communicate, generate, obtain, and/or provide program component, system, user, and/or data communications, requests, and/or responses.

The SS-Audio Database

The SS-Audio database component 919 may be embodied in a database and its stored data. The database is a stored program component, which is executed by the CPU; the stored program component portion configuring the CPU to process the stored data. The database may be a conventional, fault tolerant, relational, scalable, secure database such as Oracle or Sybase. Relational databases are an extension of a flat file. Relational databases consist of a series of related tables. The tables are interconnected via a key field. Use of the key field allows the combination of the tables by indexing against the key field; i.e., the key fields act as dimensional pivot points for combining information from various tables. Relationships generally identify links maintained between tables by matching primary keys. Primary keys represent fields that uniquely identify the rows of a table in a relational database. More precisely, they uniquely identify rows of a table on the "one" side of a one-to-many relationship.

Alternatively, the SS-Audio database may be implemented using various standard data-structures, such as an array, hash, (linked) list, struct, structured text file (e.g., XML), table, and/or the like. Such data-structures may be stored in memory and/or in (structured) files. In another alternative, an object-oriented database may be used, such as Frontier, ObjectStore, Poet, Zope, and/or the like. Object databases can include a number of object collections that are grouped and/or linked together by common attributes; they may be related to other object collections by some common attributes. Object-oriented databases perform similarly to relational databases with the exception that objects are not just pieces of data but may have other types of functionality encapsulated within a given object. If the SS-Audio database is implemented as a data-structure, the use of the SS-Audio database 919 may be integrated into another component such as the SS-Audio component 935. Also, the database may be implemented as a mix of data structures, objects, and relational structures. Databases may be consolidated and/or distributed in countless variations through standard data processing techniques. Portions of databases, e.g., tables, may be exported and/or imported and thus decentralized and/or integrated.

In one embodiment, the database component 919 includes several tables 919*a-d*. A User table 919*a* includes fields such as, but not limited to: a userID, userPasscode, userDeviceID, userAudioFile, and/or the like. The user table may support and/or track multiple entity accounts on a SS-Audio. An Hardware table 919*b* includes fields such as, but not limited to: HardwareID, HardwareType, HardwareAudioFormat, HardwareUserID, HardwareProtocol, and/or the like. A Configuration table 919*c* includes fields such as, but not limited to ConfigID, ConfigUserID, ConfigFFTSize, ConfigBitrate, ConfigOverlap, ConfigFrameLength, ConfigNoiseLevel, and/or the like. An Audio table 919*d* includes fields such as, but not limited to AudioID, AudioName, AudioFormat, AudioSource, AudioFFT, AudioLength, AudioFrequency, AudioAmplitude, AudioPhase, and/or the like.

In one embodiment, the SS-Audio database may interact with other database systems. For example, employing a distributed database system, queries and data access by search SS-Audio component may treat the combination of the SS-Audio database, an integrated data security layer database as a single database entity.

In one embodiment, user programs may contain various user interface primitives, which may serve to update the SS-Audio. Also, various accounts may require custom database tables depending upon the environments and the types of clients the SS-Audio may need to serve. It should be noted that any unique fields may be designated as a key field throughout. In an alternative embodiment, these tables have been decentralized into their own databases and their respective database controllers (i.e., individual database controllers for each of the above tables). Employing standard data processing techniques, one may further distribute the databases over several computer systemizations and/or storage devices. Similarly, configurations of the decentralized database controllers may be varied by consolidating and/or distributing the various database components 919*a-d*. The SS-Audio may be configured to keep track of various settings, inputs, and parameters via database controllers.

The SS-Audio database may communicate to and/or with other components in a component collection, including itself, and/or facilities of the like. Most frequently, the SS-Audio database communicates with the SS-Audio component, other program components, and/or the like. The database may contain, retain, and provide information regarding other nodes and data.

The SS-Audios

The SS-Audio component 935 is a stored program component that is executed by a CPU. In one embodiment, the SS-Audio component incorporates any and/or all combinations of the aspects of the SS-Audio that was discussed in the previous figures. As such, the SS-Audio affects accessing, obtaining and the provision of information, services, transactions, and/or the like across various communications networks.

The SS-Audio component enables the audio encoding, transmission, decoding and/or the like and use of the SS-Audio.

The SS-Audio component enabling access of information between nodes may be developed by employing standard development tools and languages such as, but not limited to: Apache components, Assembly, ActiveX, binary executables, (ANSI) (Objective–) C (++), C# and/or .NET, database adapters, CGI scripts, Java, JavaScript, mapping tools, procedural and object oriented development tools, PERL, PHP, Python, shell scripts, SQL commands, web application server extensions, web development environments and libraries (e.g., Microsoft's ActiveX; Adobe AIR, FLEX & FLASH; AJAX; (D)HTML; Dojo, Java; JavaScript; jQuery(UI); MooTools; Prototype; script.aculo.us; Simple Object Access Protocol (SOAP); SWFObject; Yahoo! User Interface; and/or the like), WebObjects, and/or the like. In one embodiment, the SS-Audio server employs a cryptographic server to encrypt and decrypt communications. The SS-Audio component may communicate to and/or with other components in a component collection, including itself, and/or facilities of the like. Most frequently, the SS-Audio component communicates with the SS-Audio database, operating systems, other program components, and/or the like. The SS-Audio may contain, communicate, generate, obtain, and/or provide program component, system, user, and/or data communications, requests, and/or responses.

Distributed SS-Audios

The structure and/or operation of any of the SS-Audio node controller components may be combined, consolidated, and/or distributed in any number of ways to facilitate development and/or deployment. Similarly, the component collection may be combined in any number of ways to facilitate deployment and/or development. To accomplish this, one may integrate the components into a common code base or in a facility that can dynamically load the components on demand in an integrated fashion.

The component collection may be consolidated and/or distributed in countless variations through standard data processing and/or development techniques. Multiple instances of any one of the program components in the program component collection may be instantiated on a single node, and/or across numerous nodes to improve performance through load-balancing and/or data-processing techniques. Furthermore, single instances may also be distributed across multiple controllers and/or storage devices; e.g., databases. All program component instances and controllers working in concert may do so through standard data processing communication techniques.

The configuration of the SS-Audio controller will depend on the context of system deployment. Factors such as, but not limited to, the budget, capacity, location, and/or use of the underlying hardware resources may affect deployment requirements and configuration. Regardless of if the configuration results in more consolidated and/or integrated program components, results in a more distributed series of program components, and/or results in some combination between a consolidated and distributed configuration, data may be communicated, obtained, and/or provided. Instances of components consolidated into a common code base from the program component collection may communicate, obtain, and/or provide data. This may be accomplished through intra-application data processing communication techniques such as, but not limited to: data referencing (e.g., pointers), internal messaging, object instance variable communication, shared memory space, variable passing, and/or the like.

If component collection components are discrete, separate, and/or external to one another, then communicating, obtaining, and/or providing data with and/or to other component components may be accomplished through inter-application data processing communication techniques such as, but not limited to: Application Program Interfaces (API) information passage; (distributed) Component Object Model ((D)COM), (Distributed) Object Linking and Embedding ((D)OLE), and/or the like), Common Object Request Broker Architecture (CORBA), local and remote application program interfaces Jini, Remote Method Invocation (RMI), SOAP, process pipes, shared files, and/or the like. Messages sent between discrete component components for inter-application communication or within memory spaces of a singular component for intra-application communication may be facilitated through the creation and parsing of a grammar. A grammar may be developed by using standard development tools such as lex, yacc, XML, and/or the like, which allow for grammar generation and parsing functionality, which in turn may form the basis of communication messages within and between components. For example, a grammar may be arranged to recognize the tokens of an HTTP post command, e.g.:

w3c-post http:// . . . Value1 where Value1 is discerned as being a parameter because "http://" is part of the grammar syntax, and what follows is considered part of the post value. Similarly, with such a grammar, a variable "Value1" may be inserted into an "http://" post command and then sent. The grammar syntax itself may be presented as structured data that is interpreted and/or other wise used to generate the parsing mechanism (e.g., a syntax description text file as processed by lex, yacc, etc.). Also, once the parsing mechanism is generated and/or instantiated, it itself may process and/or parse structured data such as, but not limited to: character (e.g., tab) delineated text, HTML, structured text streams, XML, and/or the like structured data. In another embodiment, inter-application data processing protocols themselves may have integrated and/or readily available parsers (e.g., the SOAP parser) that may be employed to parse communications data. Further, the parsing grammar may be used beyond message parsing, but may also be used to parse: databases, data collections, data stores, structured data, and/or the like. Again, the desired configuration will depend upon the context, environment, and requirements of system deployment.

Examples of embodiments of the SS-Audio apparatuses, systems and methods contemplated as being within the scope of the instant disclosure include:

1. An audio encoding processor-implemented method is disclosed, comprising:
   - receiving audio input from an audio source;
   - segmenting the received audio input into a plurality of audio frames;
   - for each segmented audio frame:
     - determining a plurality of sinusoidal parameters of the segmented audio frame,
     - modifying the determined plurality of sinusoidal parameters via a pre-conditioning procedure at a frequency domain,
     - converting the modified plurality of sinusoidal parameters into a modified time domain representation, obtaining a plurality of random measurements from the modified time domain representation, and generating binary representation of the segmented audio frame by quantizing the obtained plurality of random measurements; and sending the generated binary representation of each segmented audio frame to a transmission channel.

2. The method of embodiment 1, wherein the audio input comprises a monophonic audio input.

3. The method of embodiment 1, wherein the audio input comprises multi-channel audio inputs.

4. The method of embodiment 1, wherein the length of a segmented audio frame is specified by a user via a user interface.

5. The method of embodiment 1, wherein an overlapping rate between segmented audio frames is specified by a user via a user interface.

6. The method of embodiment 1, wherein the plurality of sinusoidal parameters of the segmented audio frame comprises a triad of frequencies, amplitudes and phases.

7. The method of embodiment 1, wherein determining a plurality of sinusoidal parameters of the segmented audio frame further comprises:

transforming the segmented audio frame to the frequency domain via Fast Fourier Transform (FFT); and determining a plurality of audio sinusoids.

8. The method of embodiment 7, further comprising: determining a noise component by subtracting the determined plurality of audio sinusoids from the segmented audio frame.

9. The method of embodiment 1, wherein determining a plurality of sinusoidal parameters of the segmented audio frame further comprises psychoacoustic analysis.

10. The method of embodiment 1, wherein the pre-conditioning procedure comprises spectral whitening by dividing each amplitude of the sinusoidal parameters by a quantized version of the amplitude.

11. The method of embodiment 1, wherein information pertaining to the spectral whitening is sent to the transmission channel as side information of the generated binary representation of the segmented audio frame.

12. The method of embodiment 1, wherein the pre-conditioning procedure comprises frequency mapping.

13. The method of embodiment 12, wherein the frequency mapping further comprises:

determining a frequency mapping factor for the segmented audio frame;

dividing each frequency of the sinusoidal parameters by the determined frequency mapping factor;

obtaining a mapped frequency as a floored version of the quotient; and sending the mapped frequency and a frequency remainder of the division to the transmission channel as side information of the generated binary representation of the segmented audio frame.

14. The method of embodiment 13, wherein the frequency mapping factor is determined based on characteristics of each segmented audio frame.

15. The method of embodiment 1, wherein quantizing the obtained plurality of random measurements further comprises:

normalizing values of the random measurements into an interval between zero and one;

determining a quantization level based on range of the normalized values;

determining a number of quantization bits based on the determined quantization level; and converting the normalized values of the random measurements into binary bits based on the determined number of quantization bits.

16. The method of embodiment 15, further comprising reducing the number of quantization bits by entropy coding.

17. The method of embodiment 16, wherein the entropy coding is Huffman coding.

18. The method of embodiment 1, further comprising employing forward error correction to detect frame errors.

19. The method of embodiment 18, wherein the forward error correction comprises:

retrieving a cyclic redundancy check (CRC) divisor;

dividing each frequency of the modified sinusoidal parameters by the retrieved CRC divisor;

generating CRC side information including each quotient of the division and the CRC divisor; and sending the generated CRC side information to the transmission channel.

20. In one embodiment, an audio decoding processor-implemented method is disclosed, comprising:

receiving a plurality of audio binary representations and side information from an audio transmission channel;

converting the received plurality of binary representations into a plurality of measurement values;

generating estimates of a set of sinusoidal parameters based on the plurality of measurement values;

modifying the estimates of the set of sinusoidal parameters based on the side information; and generating an audio output by transforming the modified estimates of the set of sinusoidal parameters into a time domain.

21. The method of claim 20, wherein the received side information comprises CRC information during encoding.

22. The method of embodiment 20, wherein the received side information comprises information pertaining to frequency mapping during encoding.

23. The method of embodiment 20, wherein the received side information comprises information pertaining to spectral whitening during encoding.

24. The method of embodiment 20, wherein generating estimates of a set of sinusoidal parameters comprises sparse reconstruction.

25. The method of embodiment 24, wherein the sparse reconstruction a compressed sensing based.

26. The method of embodiment 25, wherein the compressed sensing comprises:

obtaining the estimates of a set of sinusoidal parameters minimizing a Lp norm of a vector of sinusoidal frequency domain representation.

27. The method of embodiment 20, further comprising:

determining if the generated estimates are accurate based on a CRC detector.

28. The method of embodiment 27, further comprising:

retrieving a CRC divisor and CRC quotients from the received side information;

dividing estimated frequency parameters by the retrieved CRC divisor and comparing quotients with the received CRC quotients; and generating a request for retransmission when the comparison indicates inconsistency.

29. The method of embodiment 28, further comprising:

when there is no retransmission, retrieving audio frames received before and after in a time sequential order, and re-generating estimates of sinusoidal parameters by interpolating the retrieved audio frames.

30. The method of embodiment 26, wherein the compressed sensing comprises a hybrid reconstruction structure, which further comprises:

obtaining estimates based on the compressed sensing using a smoothed Lo norm; and if a CRC detector shows the obtained estimates from the smoothed Lo norm are inaccurate, re-obtaining estimates based on orthogonal matching pursuit (OMP), and if the CRC detector shows the obtained estimates from the OMP are inaccurate, re-obtaining estimates based on the compressed sensing using a $L_{1/2}$ norm.

31. The method of embodiment 30, wherein the hybrid reconstruction structure generates an error message requesting retransmission if the smoothed Lo norm, the OMP and the $L_{1/2}$ norm all fail to generate CRC-accurate estimates.

32. The method of embodiment 20, wherein modifying the estimates of the set of sinusoidal parameters based on the side information comprises spectral coloring.

33. The method of embodiment 32, wherein the spectral coloring comprises:

retrieving information pertaining to spectral whitening from the received side information; and recovering amplitudes by multiplying generated amplitude estimates by a spectral whitening quantizing factor.

34. The method of embodiment 20, wherein modifying the estimates of the set of sinusoidal parameters based on the side information comprises frequency unmapping.

35. The method of embodiment 34, wherein the frequency unmapping comprises:

retrieving a frequency mapping factor and a frequency mapping remainder from the received side information; and recovering frequency indices by multiplying generated frequency estimates by the frequency mapping factor and adding the frequency mapping remainder.

36. The method of embodiment 20, further comprising:

sending the generated audio output for reproduction.

37. In one embodiment, a multi-channel audio encoding processor-implemented method is disclosed, comprising:

receiving a plurality of audio inputs from a plurality of audio channels;

determining a primary channel input and a plurality of secondary channel inputs from the received plurality of audio inputs;

segmenting each audio input into a plurality of audio frames;

determining a plurality of sinusoidal parameters of the segmented audio frames based on all channel inputs;

for the primary audio channel input, modifying the determined plurality of sinusoidal parameters via a pre-conditioning procedure at a frequency domain;

for secondary audio channel frames, obtaining frequency indices of sinusoidal parameters from primary audio channel encoding;

converting the modified plurality of sinusoidal parameters into a modified time domain representation;

obtaining a plurality of random measurements from the modified time domain representation;

generating binary representation of the segmented audio frames of all channels by quantizing the obtained plurality of random measurements; and sending the generated binary representation of the segmented audio frames of all channels to a transmission channel.

38. The method of claim 37, wherein determining a plurality of sinusoidal parameters of the segmented audio frames based on all channel inputs comprises psychoacoustic multi-channel analysis.

39. The method of embodiment 38, wherein the psychoacoustic multi-channel analysis comprises an iterative procedure, wherein each iterative step further comprises:

for each channel, obtaining a triad of optimal sinusoidal parameters minimizing a perceptual distortion measure of the channel at the iterative step;

evaluating residual audio components at the iterative step;

if a total power of the residual audio components is no less than a threshold, proceeding with a next iterative step; and if not, outputting obtained triads of optimal sinusoidal parameters in all previous iterative steps.

40. The method of embodiment 39, wherein the perceptual distortion measure of the channel comprises a FFT of residual audio components at the iterative step.

41. The method of embodiment 39, wherein the perceptual distortion measure of the channel comprises a frequency weighting value.

42. The method of embodiment 40, wherein the frequency weighting values is obtained by summing up masker energy of each channel.

43. The method of embodiment 37, wherein frequency parameters of the primary channel input and the secondary channel inputs are equivalent.

44. In one embodiment, a multi-channel audio decoding processor-implemented method is disclosed, comprising:

receiving a plurality of audio binary representations and side information from a audio channel and a secondary audio channel;

converting the received plurality of binary representations into a plurality of measurement values;

for the primary audio channel, generating estimates of a set of sinusoidal parameters based on the plurality of measurement values, and modifying the estimates of the set of sinusoidal parameters based on the side information;

for the secondary audio channel, obtaining estimates of frequency indices of sinusoidal parameters from primary audio channel decoding; and generating audio outputs for both the primary audio channel and the secondary audio channel by transforming the modified estimates of the set of sinusoidal parameters of both channels into a time domain.

45. In one embodiment, an audio encoding processor-readable medium storing processor-issuable instructions to:

receive audio input from an audio source;

segment the received audio input into a plurality of audio frames;

for each segmented audio frame:

determine a plurality of sinusoidal parameters of the segmented audio frame, modify the determined plurality of sinusoidal parameters via a pre-conditioning procedure at a frequency domain, convert the modified plurality of sinusoidal parameters into a modified time domain representation, obtain a plurality of random measurements from the modified time domain representation, and generate binary representation of the segmented audio frame by quantizing the obtained plurality of random measurements; and send the generated binary representation of each segmented audio frame to a transmission channel.

46. In one embodiment, an audio encoding apparatus, comprising:

a memory;

a processor disposed in communication with said memory, and configured to issue a plurality of processing instructions stored in the memory, wherein the processor issues instructions to:

receive audio input from an audio source;

segment the received audio input into a plurality of audio frames;

for each segmented audio frame:

determine a plurality of sinusoidal parameters of the segmented audio frame, modify the determined plurality of sinusoidal parameters via a pre-conditioning procedure at a frequency domain, convert the modified plurality of sinusoidal parameters into a modified time domain representation, obtain a plurality of random measurements from the modified time domain representation, and generate binary representation of the segmented audio frame by quantizing the obtained plurality of random measurements; and send the generated binary representation of each segmented audio frame to a transmission channel.

47. In one embodiment, an audio decoding processor-readable medium storing processor-issuable instructions to:

receive a plurality of audio binary representations and side information from an audio transmission channel;

convert the received plurality of binary representations into a plurality of measurement values;

generate estimates of a set of sinusoidal parameters based on the plurality of measurement values;

modify the estimates of the set of sinusoidal parameters based on the side information; and generate an audio output by transforming the modified estimates of the set of sinusoidal parameters into a time domain.

48. In one embodiment, an audio decoding apparatus, comprising:

a memory;

a processor disposed in communication with said memory, and configured to issue a plurality of processing instructions stored in the memory, wherein the processor issues instructions to:

receive a plurality of audio binary representations and side information from an audio transmission channel;

convert the received plurality of binary representations into a plurality of measurement values;

generate estimates of a set of sinusoidal parameters based on the plurality of measurement values;

modify the estimates of the set of sinusoidal parameters based on the side information; and generate an audio output by transforming the modified estimates of the set of sinusoidal parameters into a time domain.

49. In one embodiment, a multi-channel audio encoding processor-readable medium storing processor-issuable instructions to:

receive a plurality of audio inputs from a plurality of audio channels;

determine a primary channel input and a plurality of secondary channel inputs from the received plurality of audio inputs;

segment each audio input into a plurality of audio frames;

determine a plurality of sinusoidal parameters of the segmented audio frames based on all channel inputs;

for the primary audio channel input, modify the determined plurality of sinusoidal parameters via a pre-conditioning procedure at a frequency domain;

for secondary audio channel frames, obtain frequency indices of sinusoidal parameters from primary audio channel encoding;

convert the modified plurality of sinusoidal parameters into a modified time domain representation;

obtain a plurality of random measurements from the modified time domain representation;

generate binary representation of the segmented audio frames of all channels by quantizing the obtained plurality of random measurements; and send the generated binary representation of the segmented audio frames of all channels to a transmission channel.

50. In one embodiment, a multi-channel audio encoding apparatus, comprising:

a memory;

a processor disposed in communication with said memory, and configured to issue a plurality of processing instructions stored in the memory, wherein the processor issues instructions to:

receive a plurality of audio inputs from a plurality of audio channels;

determine a primary channel input and a plurality of secondary channel inputs from the received plurality of audio inputs;

segment each audio input into a plurality of audio frames;

determine a plurality of sinusoidal parameters of the segmented audio frames based on all channel inputs;

for the primary audio channel input, modify the determined plurality of sinusoidal parameters via a pre-conditioning procedure at a frequency domain;

for secondary audio channel frames, obtain frequency indices of sinusoidal parameters from primary audio channel encoding;

convert the modified plurality of sinusoidal parameters into a modified time domain representation;

obtain a plurality of random measurements from the modified time domain representation;

generate binary representation of the segmented audio frames of all channels by quantizing the obtained plurality of random measurements; and send the generated binary representation of the segmented audio frames of all channels to a transmission channel.

51. In one embodiment, a multi-channel audio encoding processor-readable medium storing processor-issuable instructions to:

receive a plurality of audio binary representations and side information from a audio channel and a secondary audio channel;

convert the received plurality of binary representations into a plurality of measurement values;

for the primary audio channel, generate estimates of a set of sinusoidal parameters based on the plurality of measurement values, and modify the estimates of the set of sinusoidal parameters based on the side information;

for the secondary audio channel, obtain estimates of frequency indices of sinusoidal parameters from primary audio channel decoding; and generate audio outputs for both the primary audio channel and the secondary audio channel by transforming the modified estimates of the set of sinusoidal parameters of both channels into a time domain.

52. In one embodiment, a multi-channel audio decoding apparatus, comprising:

a memory;

a processor disposed in communication with said memory, and configured to issue a plurality of processing instructions stored in the memory, wherein the processor issues instructions to:

receive a plurality of audio binary representations and side information from a audio channel and a secondary audio channel;

convert the received plurality of binary representations into a plurality of measurement values;

for the primary audio channel, generate estimates of a set of sinusoidal parameters based on the plurality of measurement values, and modify the estimates of the set of sinusoidal parameters based on the side information;

for the secondary audio channel, obtain estimates of frequency indices of sinusoidal parameters from primary audio channel decoding; and generate audio outputs for both the primary audio channel and the secondary audio channel by transforming the modified estimates of the set of sinusoidal parameters of both channels into a time domain.

The entirety of this application (including the Cover Page, Title, Headings, Field, Background, Summary, Brief Description of the Drawings, Detailed Description, Claims, Abstract, Figures, and otherwise) shows by way of illustration various embodiments in which the claimed inventions may be practiced. The advantages and features of the application are of a representative sample of embodiments only, and are not exhaustive and/or exclusive. They are presented only to assist in understanding and teach the claimed principles. It should be understood that they are not representative of all claimed inventions. As such, certain aspects of the disclosure have not been discussed herein. That alternate embodiments may not have been presented for a specific portion of the invention or that further undescribed alternate embodiments may be available for a portion is not to be considered a disclaimer of those alternate embodiments. It will be appreciated that many of those undescribed embodiments incorporate the same principles of the invention and others are equivalent. Thus, it is to be understood that other embodiments may be utilized and functional, logical, organizational, structural and/or topological modifications may be made without departing from the scope and/or spirit of the disclosure. As such, all examples and/or embodiments are deemed to be non-limiting throughout this disclosure. Also, no inference should be drawn regarding those embodiments discussed herein relative to those not discussed herein other than it is as such for purposes of reducing space and repetition. For instance, it is to be understood that the logical and/or topological structure of any combination of any program components (a component collection), other components and/or any present feature sets as described in the figures and/or throughout are not limited to a fixed operating order and/or arrangement, but rather, any disclosed order is exemplary and all equivalents, regardless of order, are contemplated by the disclosure. Furthermore, it is to be understood that such features are not limited to serial execution, but rather, any number of threads, processes, services, servers, and/or the like that may execute asynchronously, concurrently, in parallel, simultaneously, synchronously, and/or the like are contemplated by the disclosure. As such, some of these features may be mutually contradictory, in that they cannot be simultaneously present in a single embodiment. Similarly, some features are applicable to one aspect of the invention, and inapplicable to others. In addition, the disclosure includes other inventions not presently claimed. Applicant reserves all rights in those presently unclaimed inventions including the right to claim such inventions, file additional applications, continuations, continuations in part, divisions, and/or the like thereof. As such, it should be understood that advantages, embodiments, examples, functional, features, logical, organizational, structural, topological, and/or other aspects of the disclosure are not to be considered limitations on the disclosure as defined by the claims or limitations on equivalents to the claims.

What is claimed is:

1. A multi-channel audio encoding processor-implemented method, comprising:

receiving a plurality of audio inputs from a plurality of audio channels;

determining a primary channel input and a plurality of secondary channel inputs from the received plurality of audio inputs;

segmenting each audio input into a plurality of audio frames;

determining a plurality of sinusoidal parameters of the segmented audio frames based on all channel inputs;

for the primary audio channel input, modifying the determined plurality of sinusoidal parameters via a pre-conditioning procedure at a frequency domain;

for secondary audio channel frames, obtaining frequency indices of sinusoidal parameters from primary audio channel encoding;

converting the modified plurality of sinusoidal parameters into a modified time domain representation;

obtaining a plurality of random measurements from the modified time domain representation;

generating binary representation of the segmented audio frames of all channels by quantizing the obtained plurality of random measurements; and sending the generated binary representation of the segmented audio frames of all channels to a transmission channel.

2. The method of claim 1, wherein determining a plurality of sinusoidal parameters of the segmented audio frames based on all channel inputs comprises psychoacoustic multi-channel analysis.

3. The method of claim 2, wherein the psychoacoustic multi-channel analysis comprises an iterative procedure, wherein each iterative step further comprises:

for each channel, obtaining a triad of optimal sinusoidal parameters minimizing a perceptual distortion measure of the channel at the iterative step;

evaluating residual audio components at the iterative step;

if a total power of the residual audio components is no less than a threshold, proceeding with a next iterative step; and if not, outputting obtained triads of optimal sinusoidal parameters in all previous iterative steps.

4. The method of claim 3, wherein the perceptual distortion measure of the channel comprises a FFT of residual audio components at the iterative step.

5. The method of claim 3, wherein the perceptual distortion measure of the channel comprises a frequency weighting value.

6. The method of claim 4, wherein the frequency weighting values is obtained by summing up masker energy of each channel.

7. The method of claim 1, wherein frequency parameters of the primary channel input and the secondary channel inputs are equivalent.

8. The method of claim 1, wherein the plurality of sinusoidal parameters of the segmented audio frame comprises a triad of frequencies, amplitudes and phases.

9. The method of claim 1, wherein determining a plurality of sinusoidal parameters of the segmented audio frame further comprises:

transforming the segmented audio frame to the frequency domain via Fast Fourier Transform (FFT); and determining a plurality of audio sinusoids for all channels.

10. The method of claim 1, further comprising performing spectral whitening for all channels by dividing each amplitude of the sinusoidal parameters by a quantized version of the amplitude.

11. The method of claim 1, further comprising performing frequency mapping for the primary channel.

12. The method of claim 1, further comprising obtaining random measurements for all channels.

13. The method of claim 12, further comprising quantizing the obtained random measurements.

14. The method of claim 13, wherein the quantizing further comprises:

normalizing values of the random measurements into an interval between zero and one;

determining a quantization level based on range of the normalized values;

determining a number of quantization bits based on the determined quantization level; and converting the normalized values of the random measurements into binary bits based on the determined number of quantization bits.

15. The method of claim 1, wherein the primary channel and the secondary channel share same frequency indices.

16. A multi-channel audio decoding processor-implemented method, comprising:

receiving a plurality of audio binary representations and side information from a audio channel and a secondary audio channel;

converting the received plurality of binary representations into a plurality of measurement values;

for the primary audio channel, generating estimates of a set of sinusoidal parameters based on the plurality of measurement values, and modifying the estimates of the set of sinusoidal parameters based on the side information;

for the secondary audio channel, obtaining estimates of frequency indices of sinusoidal parameters from primary audio channel decoding; and generating audio outputs for both the primary audio channel and the secondary audio channel by transforming the modified estimates of the set of sinusoidal parameters of both channels into a time domain.

17. The method of claim 16, further comprising generating estimates of a set of sinusoidal parameters for the primary channel based on sparse reconstruction.

18. The method of claim 17, further comprising spectral coloring and frequency unmapping for all channels.

19. The method of claim 16, further comprising generating estimates of amplitude and phase parameters for the secondary channel based on back-projection.

20. A multi-channel audio encoding apparatus, comprising:

a memory;

a processor disposed in communication with said memory, and configured to issue a plurality of processing instructions stored in the memory, wherein the processor issues instructions to:

receive a plurality of audio inputs from a plurality of audio channels;

determine a primary channel input and a plurality of secondary channel inputs from the received plurality of audio inputs;

segment each audio input into a plurality of audio frames;

determine a plurality of sinusoidal parameters of the segmented audio frames based on all channel inputs;

for the primary audio channel input, modify the determined plurality of sinusoidal parameters via a pre-conditioning procedure at a frequency domain;

for secondary audio channel frames, obtain frequency indices of sinusoidal parameters from primary audio channel encoding;

convert the modified plurality of sinusoidal parameters into a modified time domain representation;

obtain a plurality of random measurements from the modified time domain representation;

generate binary representation of the segmented audio frames of all channels by quantizing the obtained plurality of random measurements; and send the generated binary representation of the segmented audio frames of all channels to a transmission channel.

* * * * *